US012765631B1

(12) United States Patent
Forsey et al.

(10) Patent No.: US 12,765,631 B1
(45) Date of Patent: Oct. 20, 2026

(54) GOLF SHOE

(71) Applicant: Payntr Golf Global, LLC, Lake Oswego, OR (US)

(72) Inventors: Michael Forsey, Lake Oswego, OR (US); Michael Glancy, Duxbury, MA (US)

(73) Assignee: Payntr Golf Global, LLC, Lake Oswego, OR (US)

( * ) Notice: Subject to any disclaimer, the term of this patent is extended or adjusted under 35 U.S.C. 154(b) by 0 days.

(21) Appl. No.: 19/184,339

(22) Filed: Apr. 21, 2025

(51) Int. Cl.

| | |
|---|---|
| ***A43B 5/00*** | (2022.01) |
| ***A43B 13/12*** | (2006.01) |
| ***A43B 13/14*** | (2006.01) |
| ***A43C 15/16*** | (2006.01) |

(52) U.S. Cl.
CPC ..... *A43B 5/001* (2013.01); *A43B 13/127* (2013.01); *A43B 13/141* (2013.01); *A43C 15/161* (2013.01)

(58) Field of Classification Search
CPC ..... A43B 5/001; A43B 13/125; A43B 13/127; A43B 13/141; A43B 13/41
See application file for complete search history.

(56) References Cited

U.S. PATENT DOCUMENTS

| | | | | |
|---|---|---|---|---|
| 1,559,532 A | | 10/1925 | Smith | |
| 1,717,122 A | | 6/1929 | Schaff | |
| 4,271,607 A | | 6/1981 | Funck | |
| 4,316,335 A | | 2/1982 | Giese et al. | |
| 4,557,060 A | | 12/1985 | Kawashima | |
| 4,561,195 A | * | 12/1985 | Onoda | A43B 13/10 36/31 |
| 4,580,359 A | * | 4/1986 | Kurrash | A43B 5/001 36/107 |
| 4,586,273 A | | 5/1986 | Chapnick | |
| 4,610,101 A | | 9/1986 | Brown | |
| 4,611,413 A | | 9/1986 | Brown | |
| 4,612,713 A | | 9/1986 | Brown | |
| 4,682,425 A | | 7/1987 | Simmons | |
| 4,685,227 A | | 8/1987 | Simmons | |
| 4,733,483 A | | 3/1988 | Lin | |
| 4,742,626 A | | 5/1988 | Tadiotto | |
| 4,754,561 A | | 7/1988 | Dufour | |
| 4,766,679 A | | 8/1988 | Bender | |
| 4,793,078 A | | 12/1988 | Andrews | |

(Continued)

OTHER PUBLICATIONS

US 4,974,345 A, 12/1990, Yung-Mao (withdrawn)

(Continued)

*Primary Examiner* — Megan E Lynch
(74) *Attorney, Agent, or Firm* — Goff IP Law PLLC; Jared S. Goff

(57) ABSTRACT

A golf shoe can include an outsole including golf shoe traction features; a midsole supported by the outsole; and a propulsion plate supported by the midsole. The propulsion plate can be seated in the midsole, and the propulsion plate can be designed to return energy to a user's foot during a golf swing. The propulsion plate can extend from a heel of the golf shoe past a flex zone of the golf shoe. The golf shoe can also include an upper assembly supported by the midsole and the propulsion plate. The propulsion plate may include a positive angle at its toe section relative to a midfoot section, and the propulsion plate may include asymmetrical bending stiffness as discussed herein.

18 Claims, 17 Drawing Sheets

(56) References Cited

U.S. PATENT DOCUMENTS 4,843,741 A 7/1989 Yung-Mao
4,845,863 A 7/1989 Yung-Mao
4,852,273 A 8/1989 Hamy
4,854,057 A * 8/1989 Misevich ..... A43B 13/12 36/31
4,864,739 A 9/1989 Maestri
4,881,328 A 11/1989 Yung-Mao
4,905,382 A 3/1990 Yung-Mao
4,906,502 A 3/1990 Rudy
4,908,962 A 3/1990 Yung-Mao
5,014,706 A 5/1991 Philipp
5,025,573 A 6/1991 Giese et al.
5,086,574 A 2/1992 Bacchiocchi
5,092,060 A 3/1992 Frachey et al.
5,170,572 A 12/1992 Kantro
5,191,727 A 3/1993 Barry et al.
5,243,773 A 9/1993 Robic
5,282,325 A 2/1994 Beyl
5,283,963 A 2/1994 Lerner et al.
5,363,570 A 11/1994 Allen et al.
5,435,077 A 7/1995 Pyle
5,438,768 A 8/1995 Bauerfeind
5,528,842 A 6/1996 Ricci et al.
5,572,804 A 11/1996 Skaja et al.
5,572,805 A 11/1996 Giese et al.
5,575,089 A 11/1996 Giese et al.
5,669,162 A 9/1997 Dyer
5,689,902 A 11/1997 Juang
5,704,137 A 1/1998 Dean et al.
5,724,753 A 3/1998 Throneburg et al.
5,741,568 A 4/1998 Rudy
5,787,610 A 8/1998 Brooks
5,832,634 A * 11/1998 Wong ..... A43B 13/026 36/31
5,915,820 A 6/1999 Kraeuter et al.
5,918,383 A 7/1999 Chee
5,946,825 A 9/1999 Koh et al.
5,964,046 A 10/1999 Brooks
5,976,100 A 11/1999 Greenawalt
5,979,081 A 11/1999 Vaz
5,983,529 A * 11/1999 Serna ..... A43B 13/10 36/28
5,996,253 A 12/1999 Spector
5,996,257 A 12/1999 Harrison
6,003,250 A 12/1999 Cheong
6,026,599 A 2/2000 Blackwell et al.
6,038,790 A * 3/2000 Pyle ..... A43B 7/144 36/28
6,041,521 A 3/2000 Wong
6,120,880 A 9/2000 Crow
6,127,010 A 10/2000 Rudy
6,138,383 A 10/2000 Steinke et al.
6,167,639 B1 1/2001 Ventura
6,178,664 B1 1/2001 Yant et al.
6,219,940 B1 4/2001 Kita
6,330,757 B1 12/2001 Russell
6,381,875 B2 5/2002 Singer et al.
6,389,713 B1 * 5/2002 Kita ..... A43B 13/18 36/31
6,470,600 B1 10/2002 Louie
6,508,017 B1 1/2003 Debarro et al.
6,519,874 B1 2/2003 Dean
6,519,878 B2 2/2003 Yoshiaki
6,557,273 B2 5/2003 Polifroni
6,589,630 B1 7/2003 Crow
6,601,321 B1 8/2003 Kendall
6,658,766 B2 12/2003 Kraeuter et al.
6,691,432 B2 2/2004 Masseron
6,711,834 B1 3/2004 Kita
6,718,655 B2 4/2004 Sugawara
6,723,401 B1 4/2004 Mcknight et al.
6,754,982 B2 6/2004 Reed et al.
6,775,930 B2 8/2004 Fuerst
6,802,138 B2 10/2004 Mcmanus et al.
6,823,609 B2 11/2004 Moretti
6,842,999 B2 1/2005 Russell
6,854,198 B2 2/2005 Brooks
6,854,199 B2 2/2005 Polifroni
6,874,257 B2 4/2005 Erickson et al.
6,948,262 B2 9/2005 Casey
6,954,998 B1 * 10/2005 Lussier ..... A43B 13/141 36/31
7,007,412 B2 3/2006 Munster
7,036,245 B2 * 5/2006 Russell ..... A43B 13/185 36/3 R
7,055,198 B2 6/2006 Cadamuro et al.
7,096,604 B2 8/2006 Polegato
7,096,605 B1 * 8/2006 Kozo ..... A43B 7/26 36/76 R
7,140,126 B2 11/2006 Crane et al.
7,140,398 B2 11/2006 Dodge et al.
7,152,341 B2 12/2006 Dean
7,171,764 B2 2/2007 Pfander
7,200,955 B2 4/2007 Foxen
7,203,985 B2 4/2007 Cox et al.
7,207,125 B2 4/2007 Jeppesen et al.
7,222,443 B2 5/2007 Mitchell
7,237,346 B2 7/2007 Lebo
7,266,908 B2 9/2007 Issler
7,287,340 B2 10/2007 Talbott
7,380,352 B2 6/2008 Seiter et al.
7,434,337 B2 10/2008 Gibert et al.
7,451,557 B2 11/2008 Mcdonald et al.
7,503,132 B2 3/2009 Mason
7,650,707 B2 1/2010 Campbell et al.
7,712,231 B2 5/2010 Umezawa et al.
7,877,900 B2 2/2011 Russell
7,921,580 B2 4/2011 Russell
7,946,060 B2 5/2011 Rosenbaum
7,954,259 B2 * 6/2011 Antonelli ..... A43B 13/186 36/4
8,171,656 B2 * 5/2012 Salminen ..... A43B 23/22 36/31
8,567,093 B2 * 10/2013 Sato ..... A43B 13/12 36/27
8,607,479 B2 12/2013 Schwarz
8,826,569 B2 9/2014 Grott et al.
9,380,831 B2 7/2016 Craig et al.
9,549,589 B2 * 1/2017 Auger ..... A43B 5/02
9,615,625 B1 * 4/2017 Huard ..... A43B 13/141
9,713,357 B2 7/2017 Denison et al.
10,299,535 B2 5/2019 Hurd et al.
10,470,521 B2 * 11/2019 Iuchi ..... A43B 13/188
10,492,564 B1 12/2019 Dean et al.
10,517,351 B2 12/2019 Arciuolo et al.
10,786,040 B2 9/2020 Madore et al.
10,952,496 B2 3/2021 Glancy
2003/0000109 A1 * 1/2003 Kita ..... A43B 13/188 36/31
2004/0221485 A1 * 11/2004 Pfander ..... A43B 13/125 36/108
2006/0137227 A1 * 6/2006 Kita ..... A43B 13/181 36/102
2006/0277792 A1 * 12/2006 Schoenborn ..... A43B 13/186 36/28
2007/0145635 A1 6/2007 Cox et al.
2007/0277401 A1 12/2007 Young-Chul
2008/0052965 A1 * 3/2008 Sato ..... A43B 13/026 36/103
2008/0086909 A1 4/2008 Raspini
2008/0263895 A1 10/2008 Russell
2008/0289215 A1 11/2008 Park
2008/0289220 A1 11/2008 Rivas et al.
2008/0307671 A1 12/2008 Koffler
2009/0000148 A1 1/2009 Simmons
2009/0094855 A1 4/2009 Finkelstein
2009/0100709 A1 4/2009 Macey et al.
2009/0165333 A1 * 7/2009 Litchfield ..... A43B 13/203 36/35 B
2009/0193682 A1 * 8/2009 Rosenbaum ..... A43B 13/141 36/31

(56) References Cited

U.S. PATENT DOCUMENTS

| | | | | |
|---|---|---|---|---|
| 2009/0249648 | A1* | 10/2009 | Brown | A43B 13/26 36/134 |
| 2009/0282697 | A1 | 11/2009 | Lee | |
| 2010/0024255 | A1 | 2/2010 | Oumnia | |
| 2010/0064549 | A1 | 3/2010 | Geer et al. | |
| 2010/0313450 | A1 | 12/2010 | Morgan | |
| 2011/0162232 | A1 | 7/2011 | Gazzara et al. | |
| 2011/0283560 | A1 | 11/2011 | Portzline et al. | |
| 2012/0030971 | A9* | 2/2012 | Truelsen | A43B 13/148 36/30 R |
| 2013/0081306 | A1 | 4/2013 | Park et al. | |
| 2013/0167405 | A1 | 7/2013 | Forsey | |
| 2013/0326908 | A1* | 12/2013 | Grott | A43C 15/16 36/62 |
| 2015/0096195 | A1 | 4/2015 | Bacon et al. | |
| 2015/0157089 | A1 | 6/2015 | Schumacher et al. | |
| 2015/0282561 | A1 | 10/2015 | Swager Van | |
| 2015/0366289 | A1* | 12/2015 | Rustam | A43B 13/122 264/46.4 |
| 2016/0021977 | A1* | 1/2016 | Madore | A43B 13/12 36/30 R |
| 2016/0353836 | A1* | 12/2016 | Luedecke | A43B 13/16 |
| 2017/0157893 | A1* | 6/2017 | Simmons | A43B 13/026 |
| 2018/0084862 | A1* | 3/2018 | Bacon | A43B 5/001 |
| 2019/0261737 | A1* | 8/2019 | Walsh | A43B 13/18 |
| 2019/0387837 | A1* | 12/2019 | Luh | A43B 13/026 |
| 2020/0383421 | A1 | 12/2020 | Bidal et al. | |
| 2020/0383422 | A1 | 12/2020 | Bidal et al. | |
| 2020/0390188 | A1* | 12/2020 | Cass | A43B 13/184 |
| 2021/0127782 | A1 | 5/2021 | Devoe et al. | |
| 2022/0395049 | A1* | 12/2022 | Hong | A43B 7/142 |
| 2023/0270203 | A1* | 8/2023 | Bartel | B32B 3/263 36/28 |
| 2023/0354960 | A1* | 11/2023 | Romain | B29C 44/445 |
| 2024/0065375 | A1* | 2/2024 | Bidal | A43B 5/001 |
| 2024/0081476 | A1* | 3/2024 | Zheng | A43B 13/188 |
| 2024/0188680 | A1* | 6/2024 | Ishikawa | A43B 13/026 |
| 2025/0000199 | A1 | 1/2025 | Glancy et al. | |
| 2025/0311808 | A1* | 10/2025 | Ghedin | A43B 7/1455 |

OTHER PUBLICATIONS

Payntr Golf Footwear Construction, discussing and illustrating technology in footwear on sale prior to Apr. 21, 2024.
Carbitex Gearflex Dynamically Flexible, Accessed on Mar. 13, 2025, 8 Pages.
Carbitex Gearflex, Accessed on Mar. 27, 2025, 7 Pages.
Carbitex Monoflex Asymmetrically Flexible, Accessed on Mar. 13, 2025, 8 Pages.
Carbitex Monoflex, Accessed on Mar. 27, 2025, 7 Pages.
Carbitex Omniflex Exceptionally Flexible, Accessed on Mar. 13, 2025, 8 Pages.
Payntr Golf Post of Facebook, Dated Oct. 27, 2023, 1 Page.
Payntr Golf Post on Facebook, Dated Dec. 4, 2023, 1 Page.
Payntr Golf Post on Facebook, Dated Mar. 14, 2024, 1 Page.
Payntr Golf Product Technology, Internet Archive dated Dec. 4, 2023, 6 Pages.
Payntr Golf Spiked, Internet Archive Dated Mar. 1, 2024, 5 Pages.
Payntr Golf Spikeless, Internet Archive dated Mar. 1, 2024, 6 Pages.
Payntr Golf's Post, on Facebook, Post dated Mar. 23, 2023, 1 Page.
Shoe Lasting Constructions, Accessed on Mar. 13, 2025, 7 Pages.
Tour Alpha Carbon Triple Boa, Accessed on Mar. 13, 2025, 8 Pages.
Yujin Zhou, et al., Applications and Challenges of Supercritical Foaming Technology, MDPI, Published Jan. 12, 2023, 16 Pages.

* cited by examiner

GOLF SHOE

BACKGROUND

Golf shoes are designed to be worn by golfers while playing the game of golf. Golf shoes include golf shoe traction features, such as cleats and/or spikes that are designed specifically for producing traction during golf swings. Thus, some golf shoes are spiked golf shoes including golf spikes or at least spike receptacles that are configured to be connected to golf spikes, while others are spikeless golf shoes that do not include removable spikes or spike receptacles.

SUMMARY

According to a first aspect, a golf shoe can include an outsole including golf shoe traction features; a midsole supported by the outsole; and a propulsion plate supported by the midsole. The propulsion plate can be seated in a cavity in the midsole, and the propulsion plate can be designed to return energy to a user's foot during a golf swing. The propulsion plate can extend from a heel of the golf shoe past a flex zone of the golf shoe. The golf shoe can also include an upper assembly supported by the midsole and the propulsion plate.

According to a second aspect, a golf shoe can include an outsole that includes golf shoe traction features, a midsole supported by the outsole, and a propulsion plate supported by the midsole. The propulsion plate can be designed to return energy during a golf swing, and the propulsion plate can be designed to support a heel and toes of a wearer of the golf shoe during a golf swing. The golf shoe can also include an upper assembly supported by the propulsion plate and the midsole.

According to a third aspect, a golf shoe can include an outsole including golf shoe traction features, a midsole supported by the outsole, and a propulsion plate supported by the midsole. The propulsion plate can be designed to return energy during a golf swing, and a bending stiffness of the propulsion plate for positive bending around a medial-lateral axis can be greater than a bending stiffness of the propulsion plate for negative bending around the medial-lateral axis. The golf shoe can also include an upper assembly supported by the propulsion plate and the midsole.

The golf shoe may include other features in addition to or instead of these features. Also, a technique can include a wearer wearing a golf shoe having one or more features and/or components as discussed herein during a golf swing (i.e., while the wearer is swinging a golf club to hit a golf ball).

This Summary is provided to introduce a selection of concepts in a simplified form. The concepts are further described below in the Detailed Description. This Summary is not intended to identify key features or essential features of the claimed subject matter, nor is it intended to be used to limit the scope of the claimed subject matter. Similarly, the invention is not limited to implementations that address the particular techniques, tools, environments, disadvantages, or advantages discussed in the Background, the Detailed Description, or the attached drawings.

BRIEF DESCRIPTION OF THE DRAWINGS

The description and drawings may refer to the same or similar features in different drawings with the same reference numbers.

DETAILED DESCRIPTION

I. Spiked Golf Shoe Example

Figure 1:
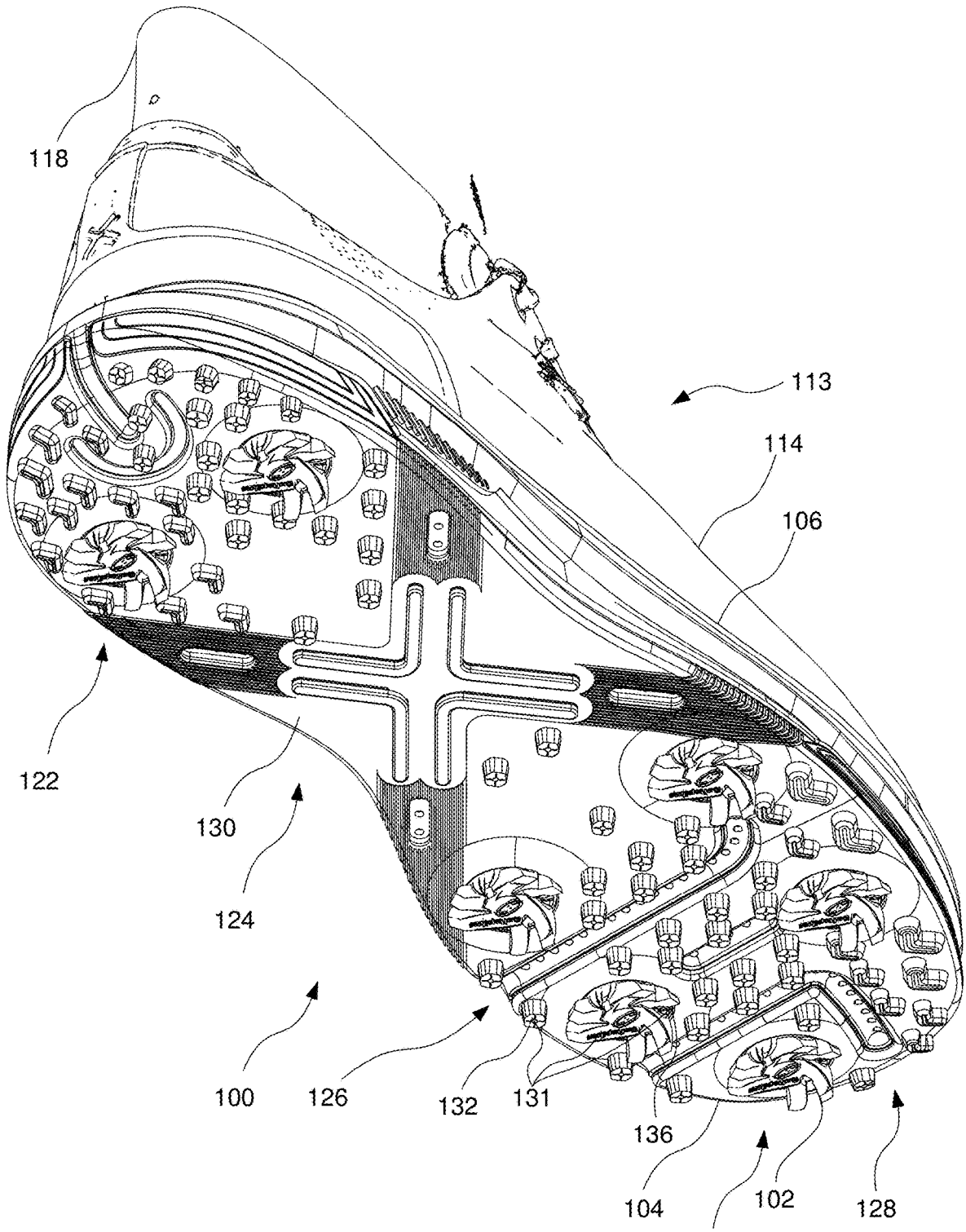
FIG. 1 is a bottom rear (posterior) lateral perspective view of a golf shoe for a right foot. A left golf shoe can be a mirror image of the right golf shoe.
Figure 2:
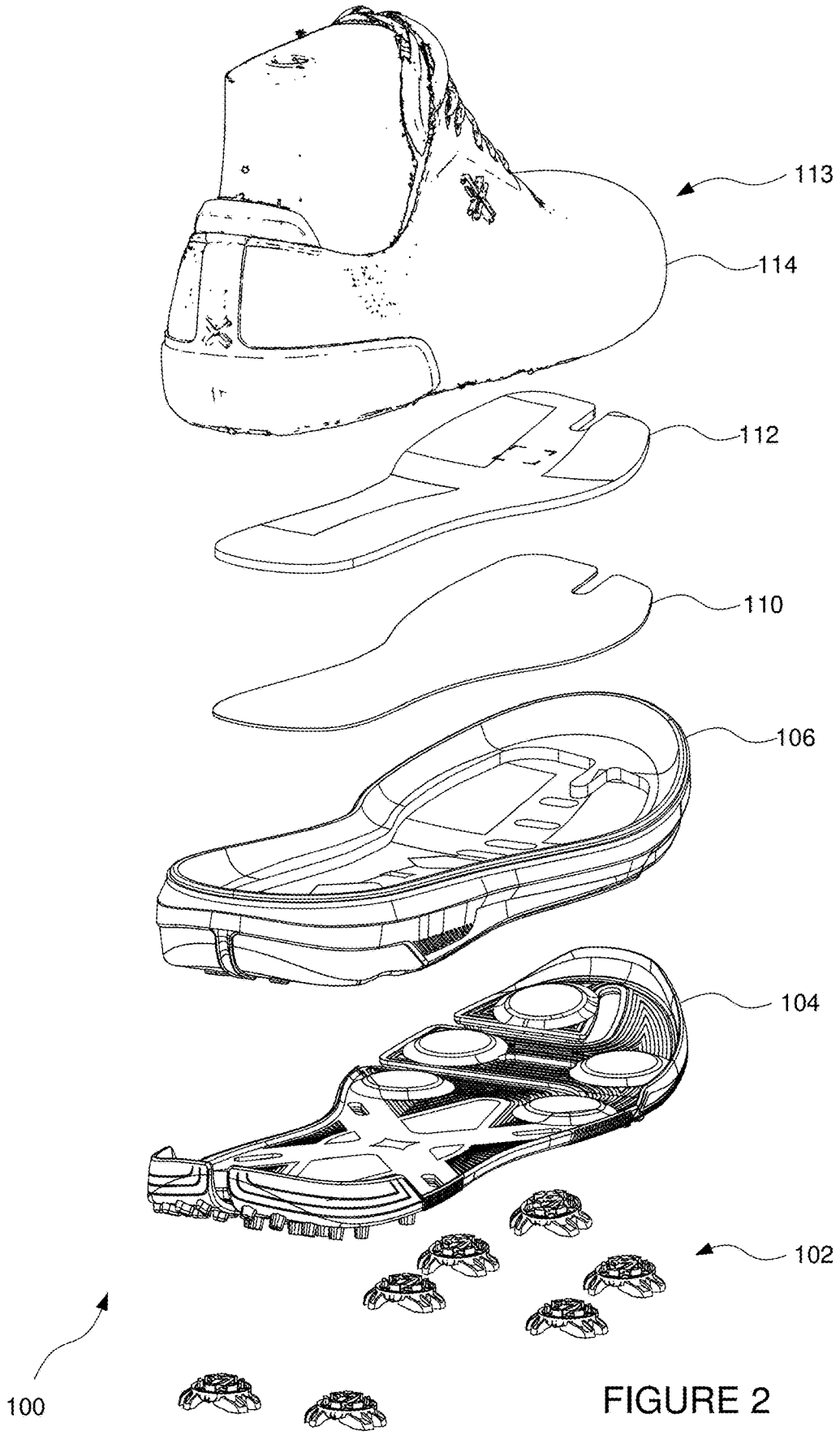
FIG. 2 is an exploded top rear lateral perspective view of the golf shoe of FIG. 1.

Referring to FIGS. 1-2, a golf shoe 100 will be discussed. The golf shoe 100 is an example of a spiked golf shoe. The golf shoe 100 can include spikes 102, although the golf shoe 100 can be considered a golf shoe with golf shoe traction features as used herein without the spikes 102 because an outsole 104 of the golf shoe 100 includes spike receptacles configured to be connected to such spikes 102. The golf shoe 100 can include the outsole 104, a midsole 106, a propulsion plate 110, a filler 112, and an upper assembly 113 that can include an upper 114, and can also include other components such as a Strobel construction sock, a waterproof breathable membrane gasket, and a footbed. The spikes 102 can be connected to the bottom of the outsole 104. The outsole 104 can support the midsole 106, and the midsole 106 can support the propulsion plate 110. The propulsion plate 110 can support the filler 112. The filler 112 and the midsole 106 can support the upper assembly 113 that can include a footbed that can support a foot of the wearer 118 while the wearer is playing golf (the wearer 118 is not considered to be part of the golf shoe 100). Each of the components of the golf shoe 100 are discussed in more detail below.

The golf shoe 100 can include multiple areas, including a heel 122 at the rear or posterior end area of the golf shoe 100 in a position to support the heel of the foot of the wearer 118. The golf shoe 100 can also include a midfoot area 124 located forward of the heel 122, with the midfoot area 124 typically including an area beneath the arch of a foot of the wearer 118. A flex zone 126 can be located forward of the midfoot area 124. The flex zone 126 may be configured to be located approximately beneath the ball of the foot of the wearer 118 so that the flex zone 126 can support the ball of the foot of the wearer 118 and also flex in response to flexing of the foot of the wearer 118 at the ball of the wearer's foot. A toe box 128 of the golf shoe 100 can be located forward of the flex zone 126. The toe box 128 can be configured to support the toes of the foot of the wearer 118.

Figure 3:
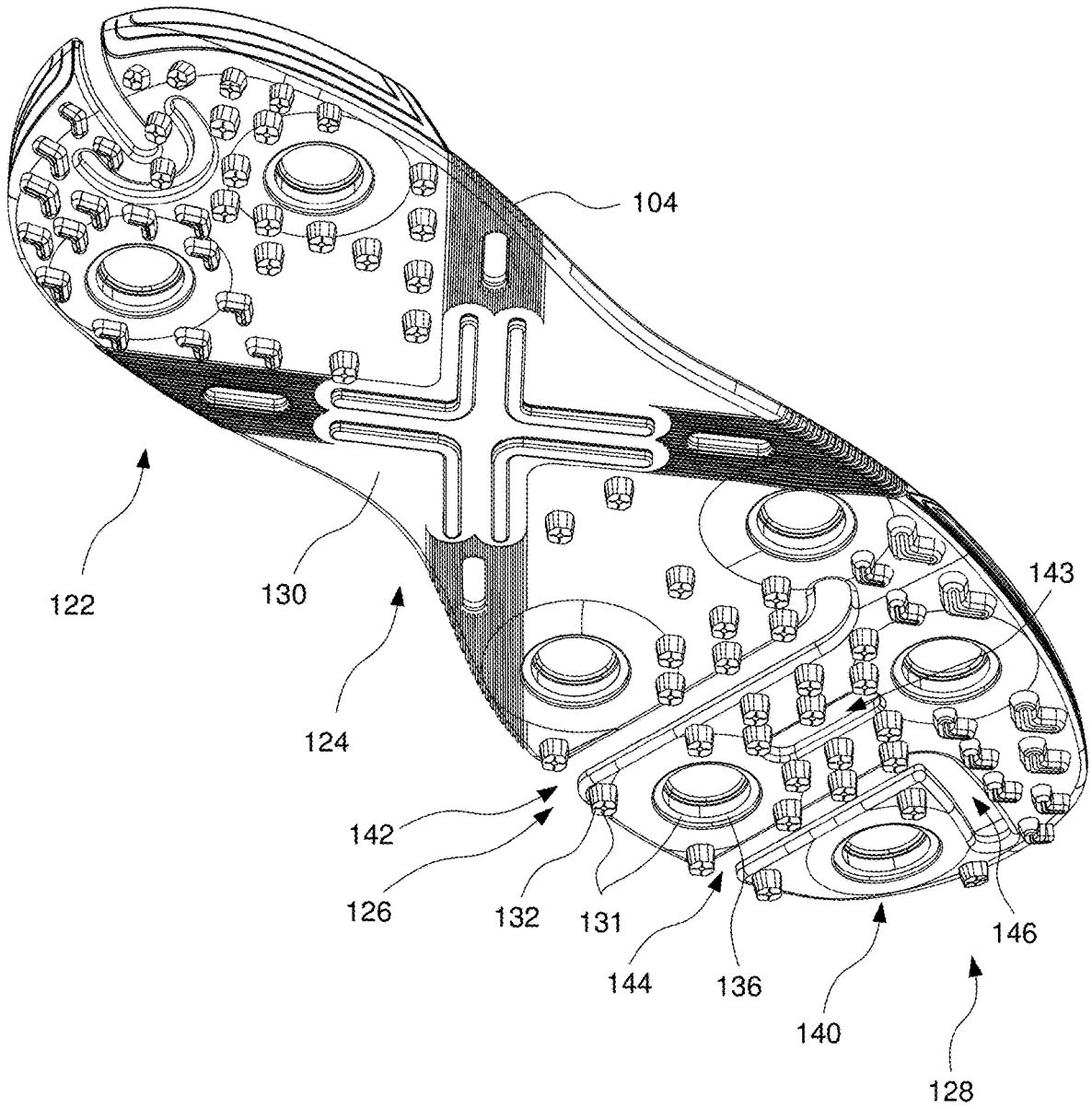
FIG. 3 is a bottom rear lateral perspective view of the outsole of the golf shoe of FIG. 1.
Figure 4:
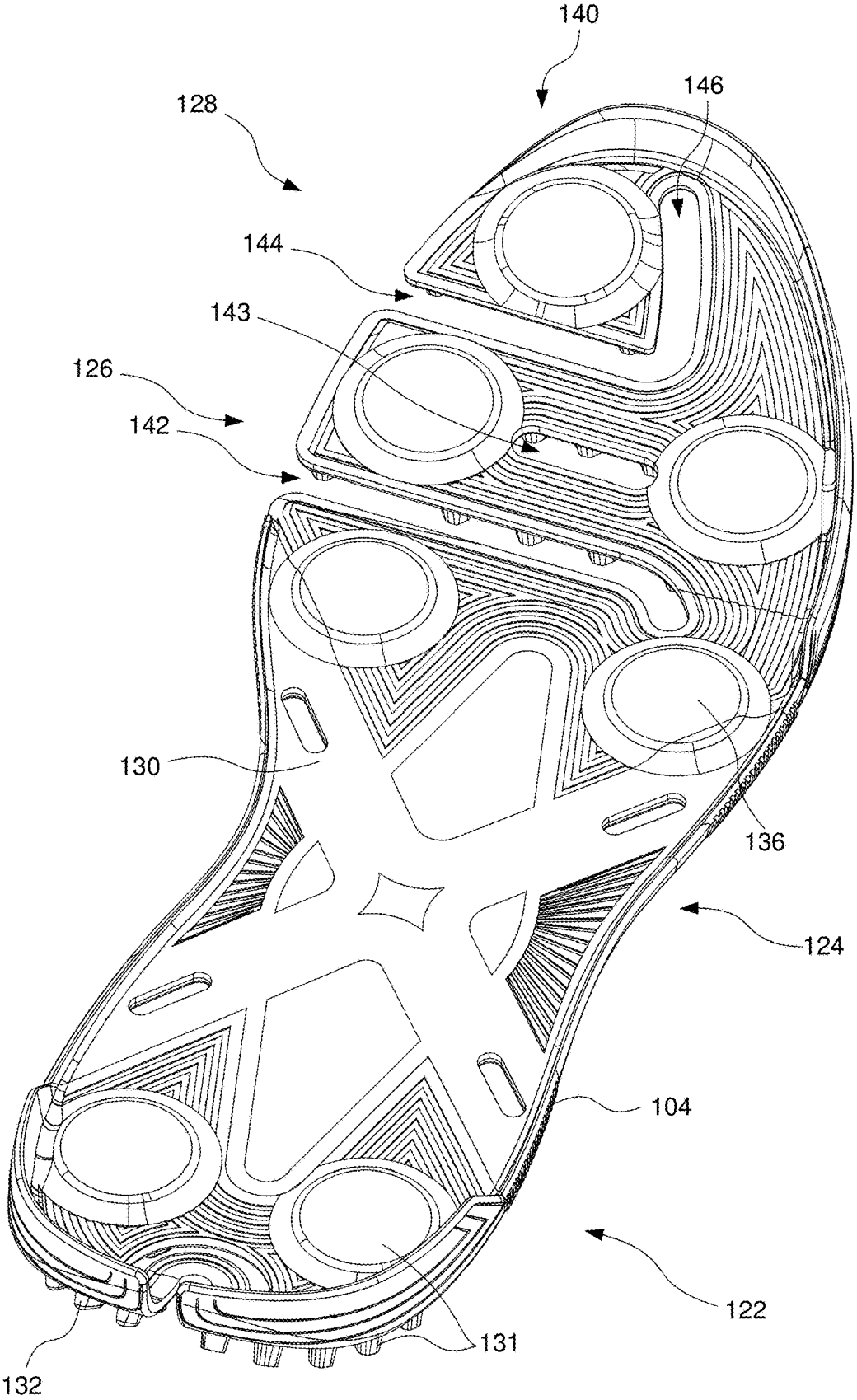
FIG. 4 is a top rear lateral perspective view of the outsole of FIG. 3.

Referring to FIGS. 1-4, the outsole 104 can include an outsole body 130. The outsole 104 can also include golf shoe traction features 131, which can include cleats 132 extending down from the outsole body 130. The cleats 132 may be integrally formed with the outsole body 130. For example, the cleats 132 and the outsole body 130 can be integrally formed as a single part or possibly as multiple parts. The cleats 132 and the outsole body 130 may be formed of a somewhat flexible material such as TPU (Thermoplastic Polyurethane). The golf shoe traction features 131 of the outsole 104 can also include spike receptacles 136 (the illustration in FIG. 3 is missing some of the details of the spike receptacles that would engage with the spikes 102), which can be configured to be connected to the spikes 102 (which are also golf shoe traction features 131), with the spikes 102 extending down from the spike receptacles 136 as illustrated in FIG. 1. For example, each of the spikes 102 may be connected to a corresponding one of the spike receptacles 136 by mating the spike with the spike receptacle and rotating the spike relative to the spike receptacle in a first direction. The spikes 102 may be disconnected from the corresponding spike receptacles 136 by rotating the spikes 102 in a second direction that is opposite the first direction.

The spike receptacles 136 can include a spike receptacle 136 on the medial side of the outsole 104 at the heel 122, a spike receptacle 136 on the lateral side of the outsole 104 at the heel 122, a spike receptacle 136 on a medial side of the outsole 104 just to the rear or posterior side of the flex zone 126, a spike receptacle 136 on a lateral side of the outsole 104 just to the rear of the flex zone 126, a spike receptacle 136 on a medial side of the outsole 104 just forward of the flex zone 126, a spike receptacle 136 on a lateral side of the outsole 104 just forward of the flex zone 126, and a spike receptacle 136 on a medial side of the toe box 128 in a first toe area 140 of the golf shoe 100 (where the golf shoe 100 is configured to receive and support a first toe (i.e., big toe) of the wearer 118).

The outsole 104 can include one or more apertures therein such as grooves or gaps to facilitate flexing of the golf shoe 100 along the apertures. For example, the outsole 104 can define a gap 142 extending substantially laterally along the flex zone 126 from a medial side of the outsole 104. The gap 142 can promote flexibility as the shoe bends at the flex zone 126 around at least one medial-lateral axis (i.e., an axis extending in a substantially medial-lateral direction). The outsole 104 can also define a substantially laterally extending gap 143 between the spike receptacles 136 located just forward of the flex zone 126, which can further promote flexibility in bending of the golf shoe 100 around at least one medial-lateral axis near the flex zone 126 and the toe box 128. Additionally, the outsole 104 can define a substantially laterally extending gap 144 extending just behind the first toe area 140 (indeed, the laterally extending gap 144 may be located beneath a portion of a first toe of the wearer 118). The substantially laterally extending gap 144 can promote flexibility in bending of the golf shoe around at least one medial-lateral axis just to the rear or posterior side of the first toe area 140 (and again, possibly located beneath a portion of a first toe of the wearer 118). The outsole 104 can also define a substantially forwardly extending gap 146, which can be located laterally of the first toe area 140, such as between the first toe area 140 and an area supporting a second toe of the wearer 118 or located beneath an area supporting the second toe of the wearer 118. The substantially forwardly extending gap 146 can connect to the substantially laterally extending gap 144 so that the gaps form a substantial L shape (which may be a reversed L shape, depending on the perspective). These gaps can help promote flexibility of the first toe area 140 relative to areas of the golf shoe 100 located to the rear (posterior of) and/or laterally of the first toe area 140.

Figure 5:
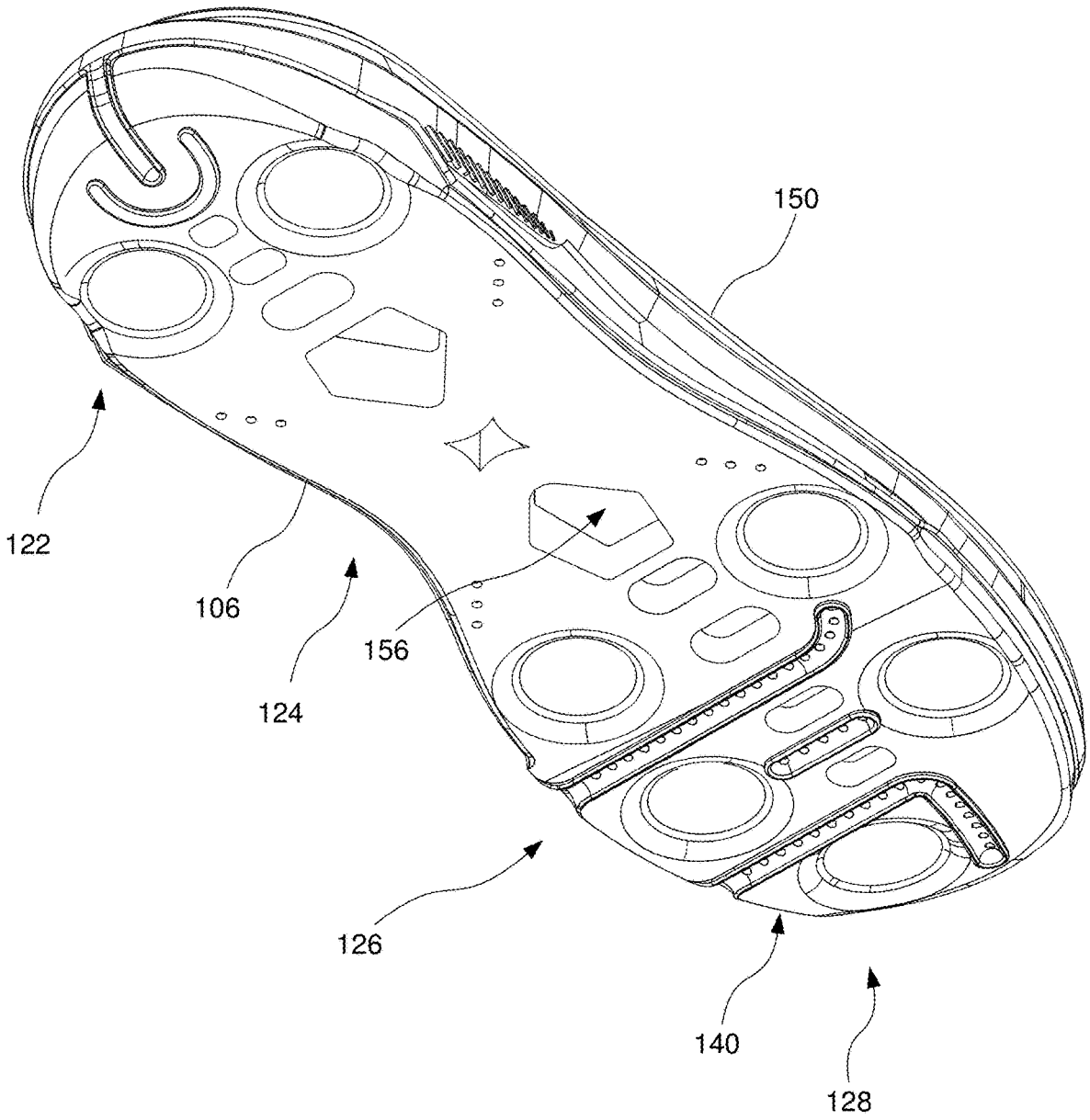
FIG. 5 is a bottom rear lateral perspective view of a midsole of the golf shoe of FIG. 1.
Figure 6:
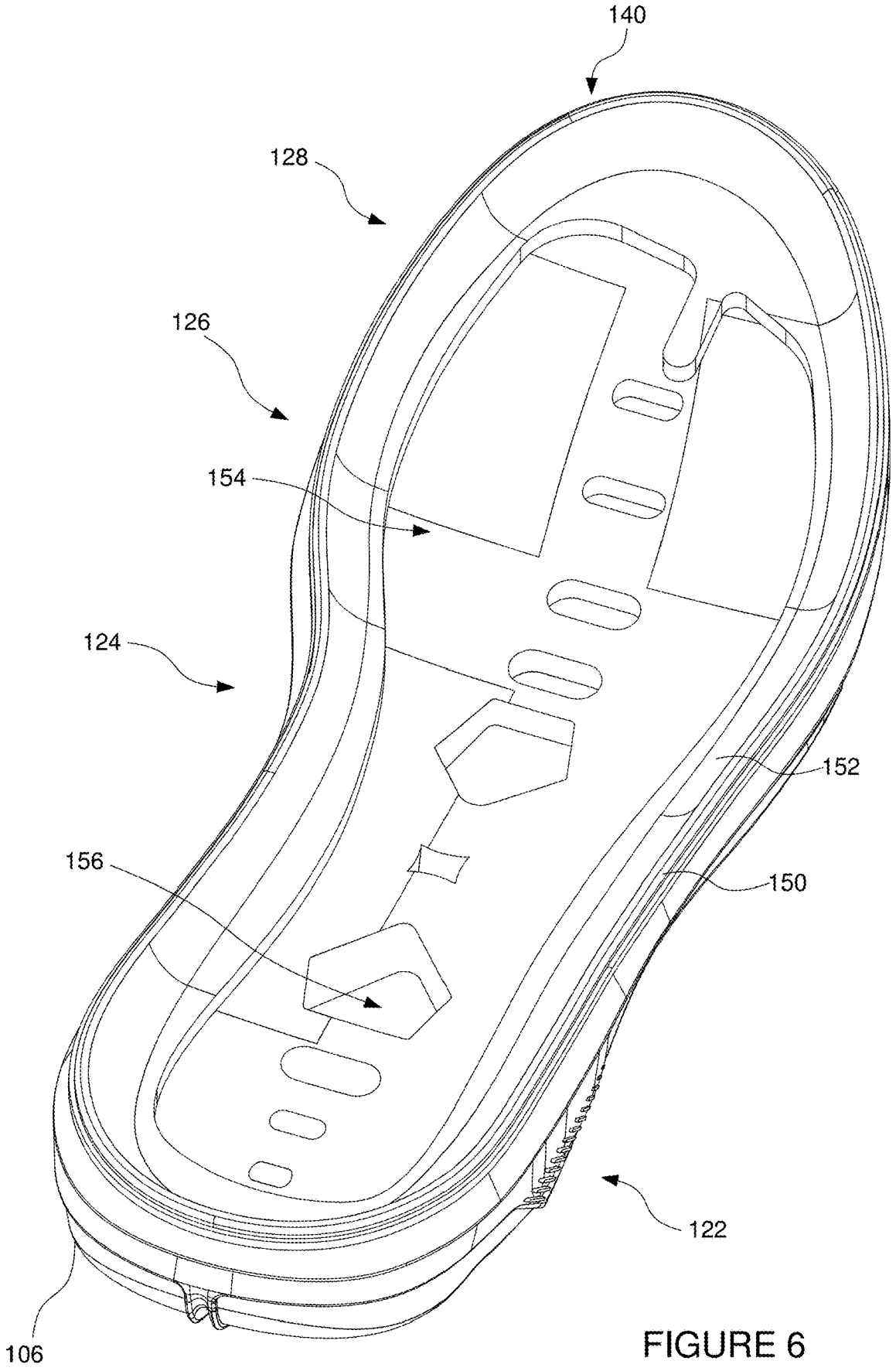
FIG. 6 is a top rear lateral perspective view of the midsole of FIG. 5.
Figure 7:
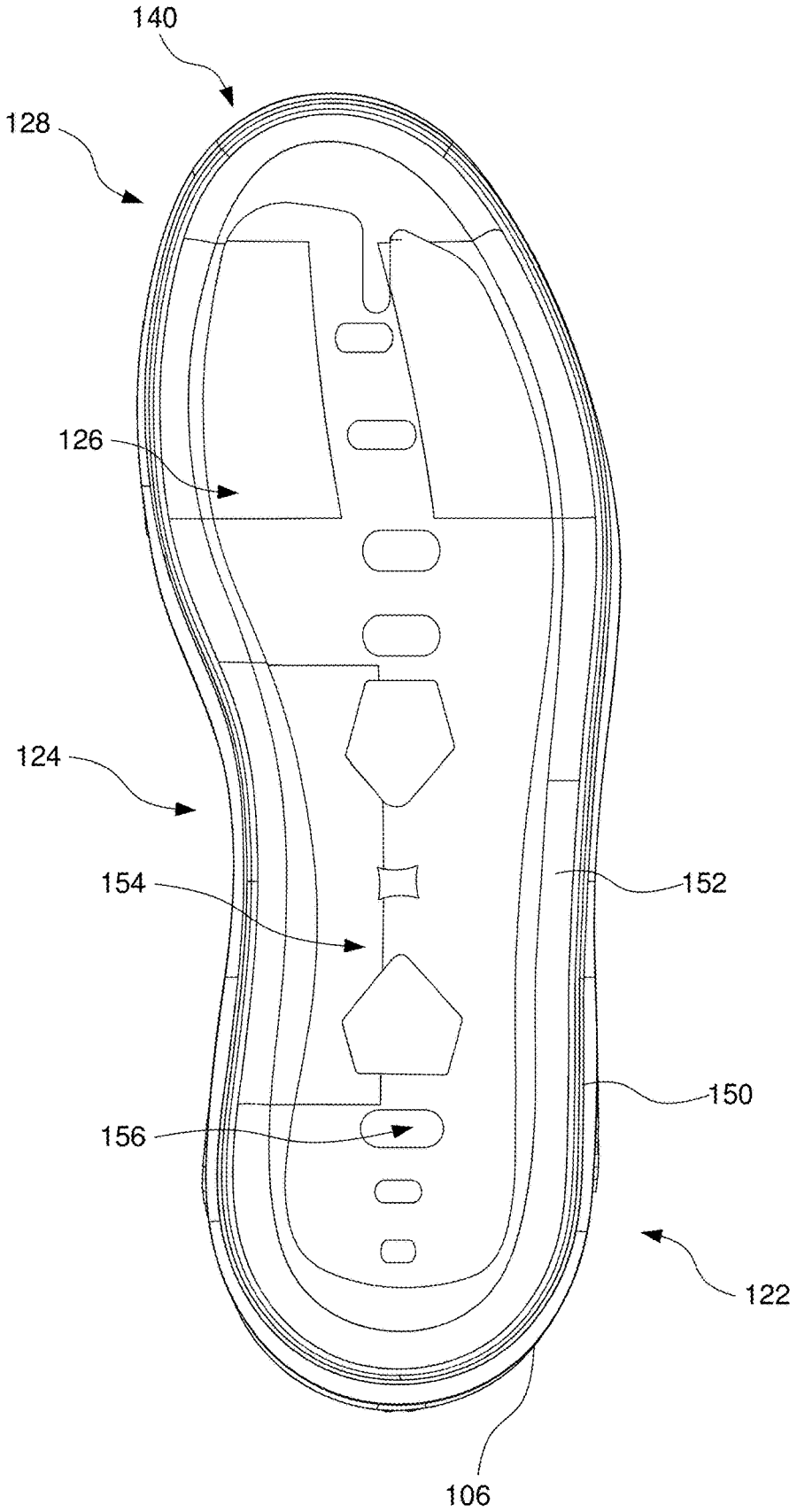
FIG. 7 is a top view of the midsole of FIG. 5.

Referring to FIGS. 1-7, and especially to FIGS. 5-7, the midsole 106 can be formed of a foam material such as a supercritical foam. For example, the foam material may be a nitrogen infused supercritical foam. The foam material may have a hardness of from forty-seven to fifty-three using an Asker durometer Type C hardness test. In one example, the foam may have a hardness of fifty using the Asker durometer Type C hardness test. The foam material of the midsole 106 can also have other characteristics that are appropriate for midsole foam of a golf shoe, such as a specific gravity that is not more than 0.21 grams per cubic centimeter, a resilience that is at least fifty-five percent, a compression set that is not more than sixty-five percent, a split tear that is at least two kilograms force per centimeter, and a shrinkage that is not greater than three.

The bottom of the midsole 106 can be formed to fit with the top of the outsole 104. For example, the bottom of the midsole 106 may include spike receptacle recesses that receive upper portions of the spike receptacles 136 and/or portions of the outsole body 130 around the spike receptacles 136. Also, the midsole 106 can include flexing features such as grooves and/or perforations that are aligned with the gaps in the outsole 104 discussed above.

The top of the midsole 106 can include an upward extending rim 150 extending around a periphery of the midsole 106. The rim 150 can be concavely rounded as it extends in from the top of the rim 150 to form a trough 152. An upward opening plate cavity 154 can extend down from the top of the midsole 106 in the trough 152, with an outline of the plate cavity 154 matching an outline of the propulsion plate 110 and an outline of the filler 112. The plate cavity 154 can extend deeply enough to receive the thickness of the propulsion plate 110 and the filler 112 within the plate cavity 154. The plate cavity 154 and the propulsion plate 110 can extend across most of the width of the midsole 106 in many areas. For example, at a line extending across a part of the flex zone 126, the width of the propulsion plate 110 and the plate cavity 154 can be about seventy percent to seventy five percent (or at least seventy or at least seventy five percent) of the width midsole 106. And the width of the propulsion plate 110 may be at least sixty percent or at least sixty five percent of the width of the midsole 106 at a line extending laterally across a part of the flex zone 126.

The midsole 106 can also define air gaps 156 that can extend down through the midsole 106 to form air pockets therein that may assist with cushioning and responsiveness of the golf shoe 100. The thickness of the midsole 106 from the bottom of the plate cavity 154 to the bottom surface of the midsole 106 can vary along the midsole 106. For example, this thickness may be greater at the heel 122 than in the flex zone 126 and toe box 128 of the golf shoe 100. As an example, this thickness may be about fifteen millimeters thick at the heel 122 of the golf shoe 100, and about six millimeters thick at the flex zone 126 and the toe box 128 of the golf shoe.

Referring now to FIGS. 1-12, and especially to FIGS. 8-12, the propulsion plate 110 will be discussed. As used herein, a propulsion plate is a plate that is positioned in a golf shoe and is designed to provide energy return and stiffness during a golf swing. The propulsion plate 110 can be seated in the bottom of the plate cavity 154 of the midsole 106, with the bottom of the propulsion plate 110 being in contact with the bottom of the plate cavity 154 across the bottom surface of the propulsion plate 110. Of course, the propulsion plate 110 will not be in contact with the plate cavity 154 in areas where the propulsion plate 110 is above the air gaps 156 of the midsole 106 that extend down from the plate cavity 154 (keeping in mind that the plate cavity 154 itself may be an air gap).

The propulsion plate 110 can be a thin plate, such as a carbon fiber plate on the order of about one millimeter thick. The propulsion plate 110 can include a heel section 160 at the heel 122 of the golf shoe 100, a midfoot section 162 at the midfoot area 124 of the golf shoe 100, a flex section 164 at the flex zone 126 of the golf shoe 100, and a toe section 166 at the toe box 128 of the golf shoe 100.

Figure 10:
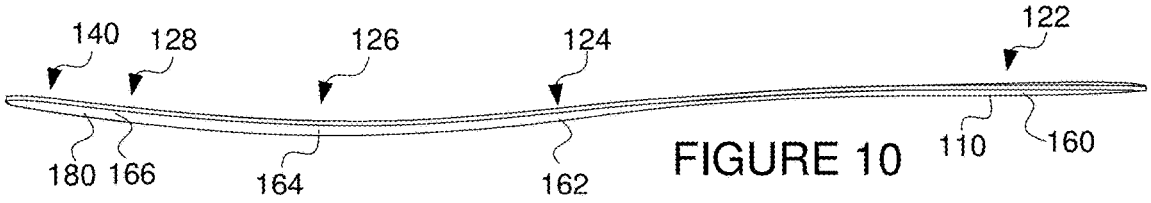
FIG. 10 is a medial side view of the propulsion plate of FIG. 8.
Figure 11:
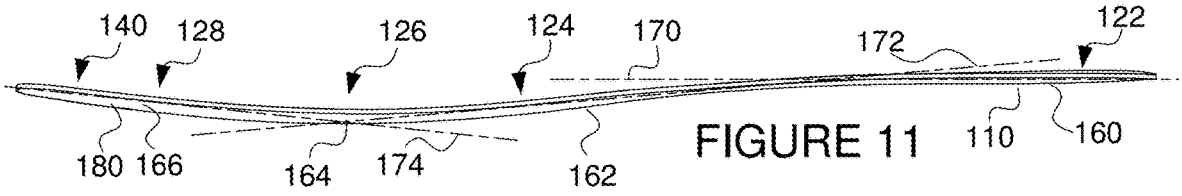
FIG. 11 is a view like FIG. 10, but with dashed angle lines added for purposes of discussion.

As illustrated in FIG. 11 and also seen in FIG. 10, the heel section 160, the midfoot section 162, and the toe section 166 can be angled relative to each other, as seen from the side. For example, relative to the heel section 160, the midfoot section 162 may slope down as it extends forward until the midfoot section 162 is sloping down along slope line 172 at a minimum angle of about five degrees relative to the heel section 160 that is extending along slope line 170. Also, relative to the midfoot section 162, the toe section 166 can slope up as it extends forward until the toe section 166 is sloping up along slope line 174 at a maximum positive angle of about eleven degrees relative to the midfoot section 162 (and about six degrees relative to the heel section 160). However, different angles may be used in different designs. For example, the maximum positive angle of the toe section 166 relative to the midfoot section 162 may be from about five degrees to about sixteen degrees, and in an example may be about eleven degrees.

Figure 8:
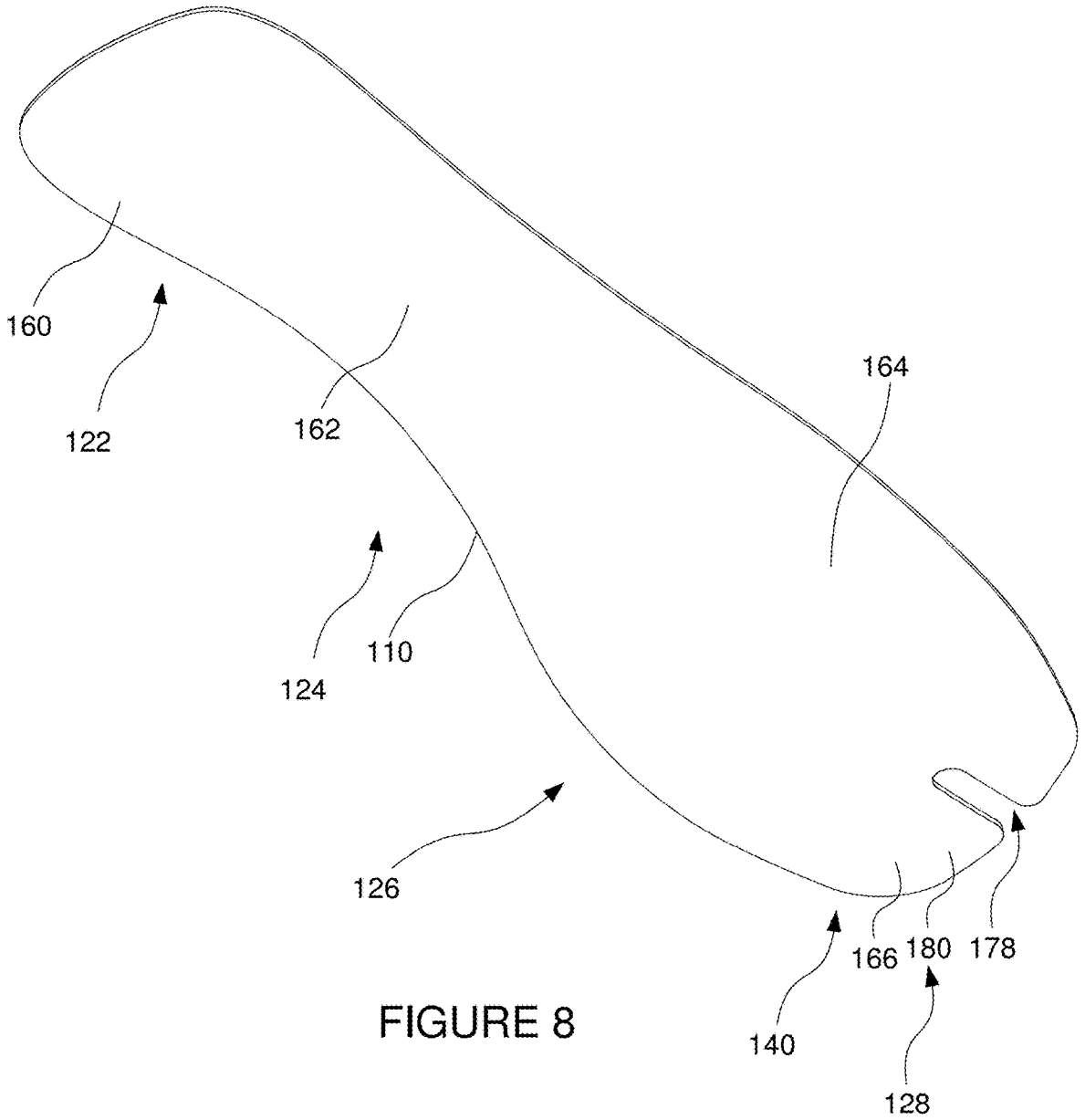
FIG. 8 is a bottom rear lateral perspective view of a propulsion plate of the golf shoe of FIG. 1.
Figure 9:
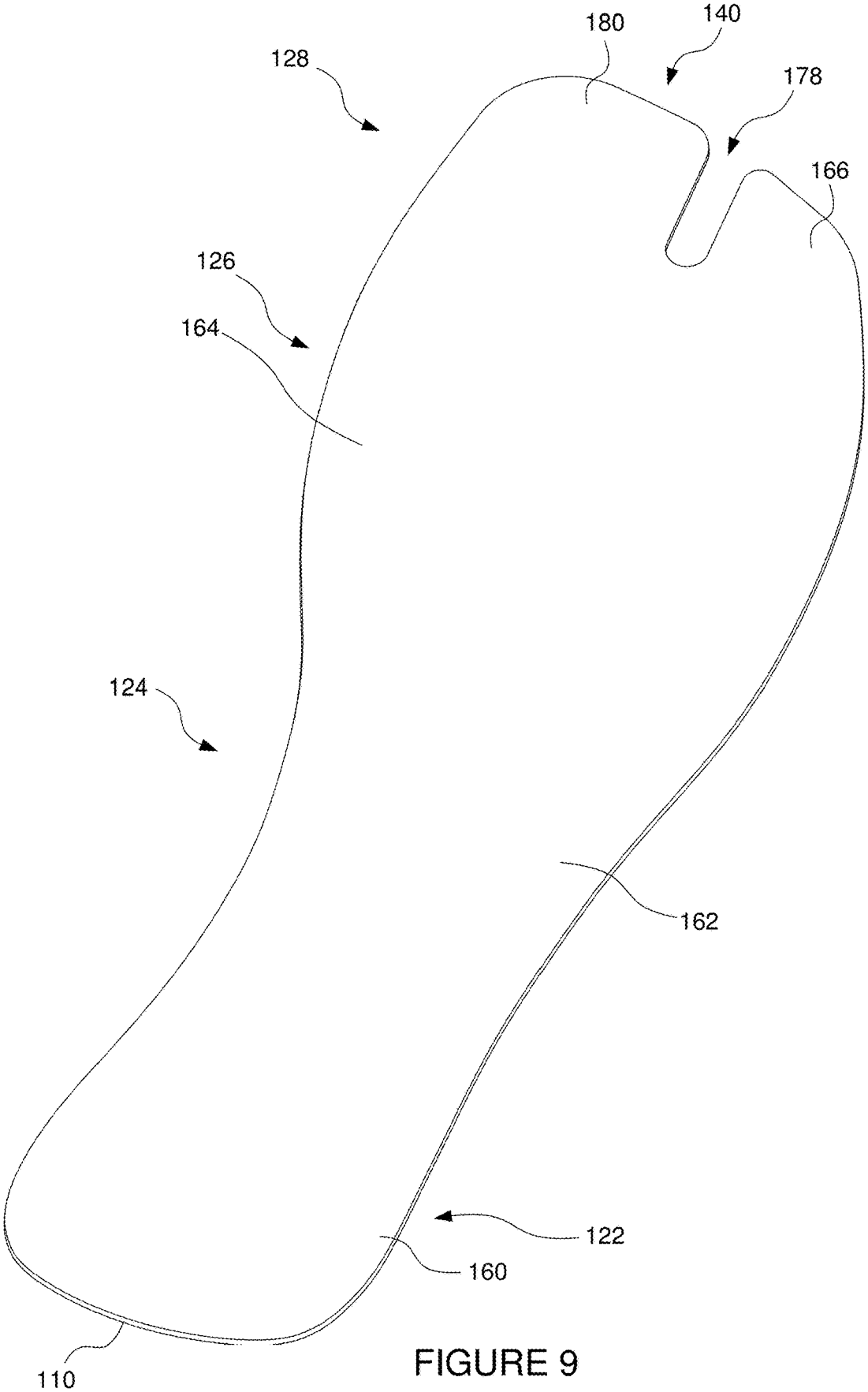
FIG. 9 is a top rear lateral perspective view of the propulsion plate of FIG. 8.
Figure 12:
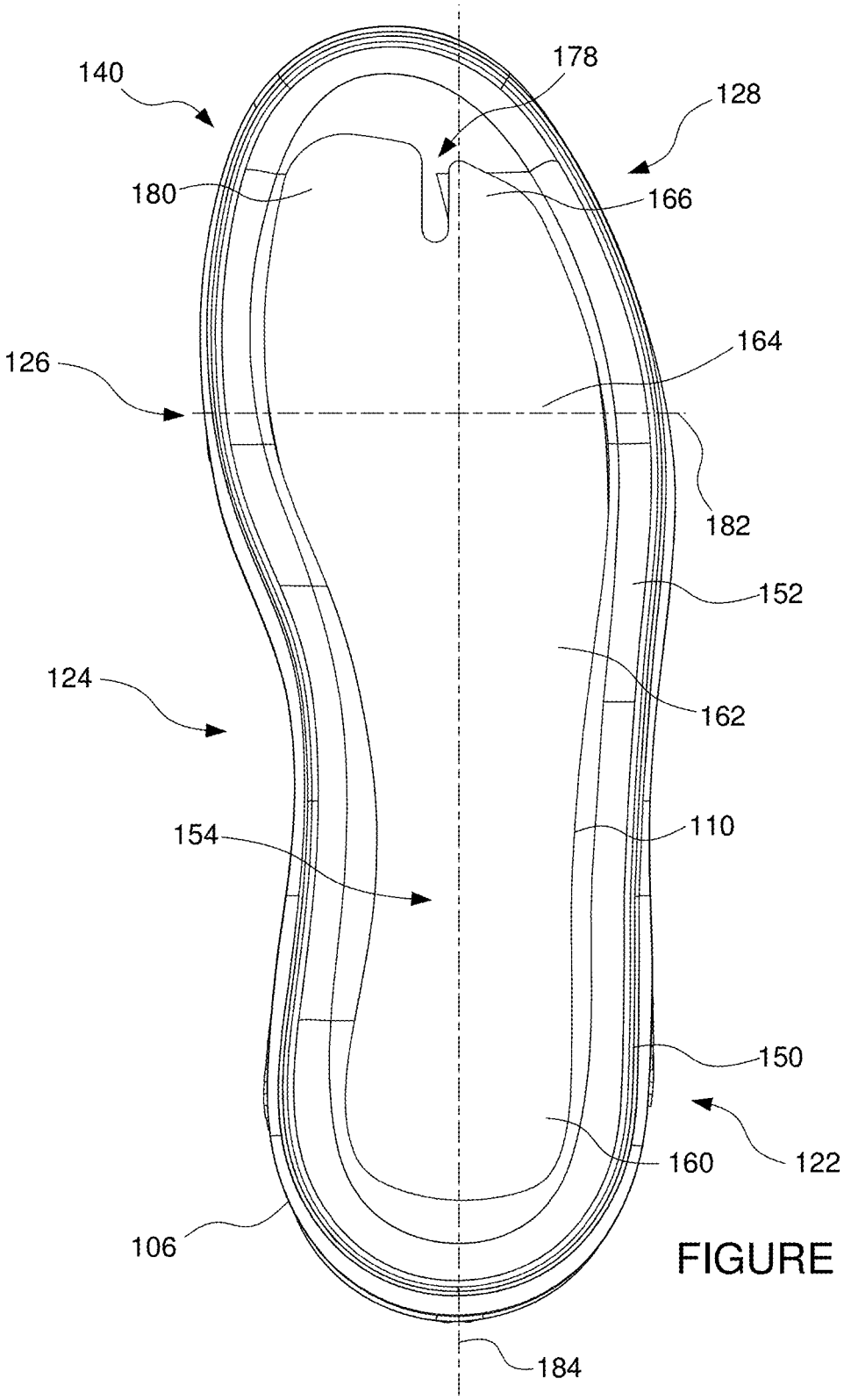
FIG. 12 is a top view of the midsole of the golf shoe of FIG. 1 with the propulsion plate positioned in a cavity of the midsole.

As seen in FIGS. 8-9 and FIG. 12, the propulsion plate 110 can be wider in a medial-lateral direction at the flex section 164 than at the heel section 160. Also, the propulsion plate 110 may extend in the medial-lateral direction across most of the trough 152 of the midsole 106. Indeed, for a spiked shoe such as the golf shoe 100, the propulsion plate 110 may extend across at least eighty percent or ninety percent of the width of the bottom of the trough 152 at the flex section 164 of the propulsion plate 110. However, in other examples such as in spikeless golf shoes, the propulsion plate 110 may cover less of the bottom of the trough 152, including at the flex section 164 of the propulsion plate, such as at least about eighty percent or at least about seventy percent. Also, for a spiked shoe such as the golf shoe 100, the propulsion plate may extend over at least a portion of each of the spike receptacles 136. This may assist in reducing localized pressure on the foot of the wearer 118 due to forces coming from the spikes 102. Additionally, it can be advantageous to have the propulsion plate 110 cover a sufficiently large area to inhibit sliding or rotation of the foot of the wearer 118 off to the side of the plate during a golf swing, which may cause the wearer 118 to lose at least some stability and/or energy return from the propulsion plate 110 during a golf swing.

The propulsion plate can define a gap 178 extending rearward (in the posterior direction, which may be in a posterior direction that is not exactly front-to-back) from the front (anterior end) of the propulsion plate 110 and into the propulsion plate 110, separating a first toe section 180 of the propulsion plate 110 from the remainder of the toe section 166 of the propulsion plate 110. This may allow the first toe section 180 of the propulsion plate 110 to move somewhat independently to allow the first toe of the wearer 118 to apply force through the golf shoe 100 and into the ground for a longer time period during some golf swings. The gap 178 can be aligned with the substantially forwardly extending gap 146 of the outsole 104 and the other corresponding flexing features such as grooves and/or perforations in the midsole 106. These flexing features can each allow greater flexibility at the feature than in surrounding areas, and can work together to facilitate flexing of the first toe area relative to the remainder of the toe box 128 of the golf shoe 100 during golf swings.

The propulsion plate 110 can be constructed to allow greater bending in some directions than in other directions, even when the bending is in different directions in the same area of the propulsion plate. For example, a bending stiffness of the propulsion plate 110 for positive bending (bending up at end areas relative to a central area between the end areas) around a medial-lateral axis (bending up at the anterior and posterior ends relative to an area between the anterior and posterior ends), such as a medial-lateral axis 182 illustrated in FIG. 12 at the flex section 164 or another medial-lateral axis, can be greater than a bending stiffness of the propulsion plate for negative bending (bending down at end areas relative to a central area between the end areas) around that medial-lateral axis (bending down at anterior and posterior ends relative to an area between the anterior and posterior ends). Also, a bending stiffness of the propulsion plate can be less stiff for negative bending around the medial-lateral axis than for positive bending around an anterior-posterior (extending from front to rear) axis (bending up at medial and lateral sides relative to an area between the medial and lateral sides), such as an anterior-posterior axis 184 illustrated in FIG. 12 or another anterior-posterior axis 184, or negative bending around the anterior-posterior axis (bending down at medial and lateral sides relative to an area between the medial and lateral sides) in an intersecting area of the propulsion plate. The bending stiffness of the propulsion plate can be such that the stiffness is not so great as to make walking overly uncomfortable (especially for negative bending of the propulsion plate around a medial-lateral axis) but is great enough to provide sufficient stiffness and energy return during a golf swing (such as for positive bending of the propulsion plate around a medial-lateral axis and for positive and negative bending of the propulsion plate around an anterior-posterior axis).

As an example, the negative bending with lower stiffness around a medial-lateral axis may be produced more while the wearer 118 is walking, while the positive bending around a medial-lateral axis and/or bending around an anterior-posterior axis, all with higher bending stiffness, may be produced more during a golf swing. This may result in better energy return, responsiveness, and force transfer of the golf shoe 100 during a golf swing, but greater comfort when walking in the golf shoe 100, especially when combined with other features discussed herein.

The propulsion plate can be made of a composite material, such as a carbon fiber composite material exhibiting asymmetrical bending as discussed above. For example, the propulsion plate may be made of material provided under the name GearFlex by Carbitex, Inc. of Kennewick, Washington in the United States of America.

Figure 13:
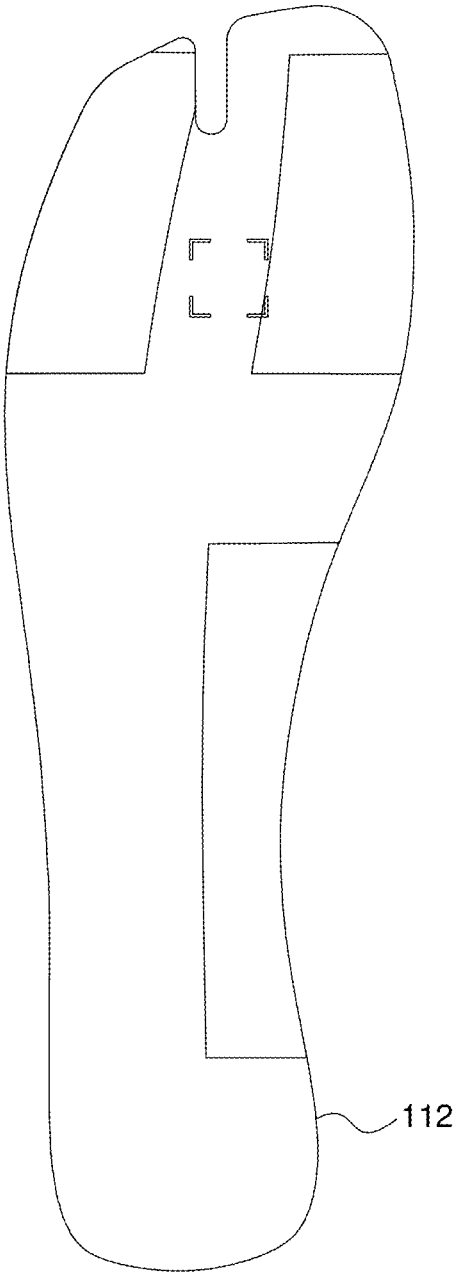
FIG. 13 is a top view of a filler of the golf shoe of FIG. 1.
Figure 14:
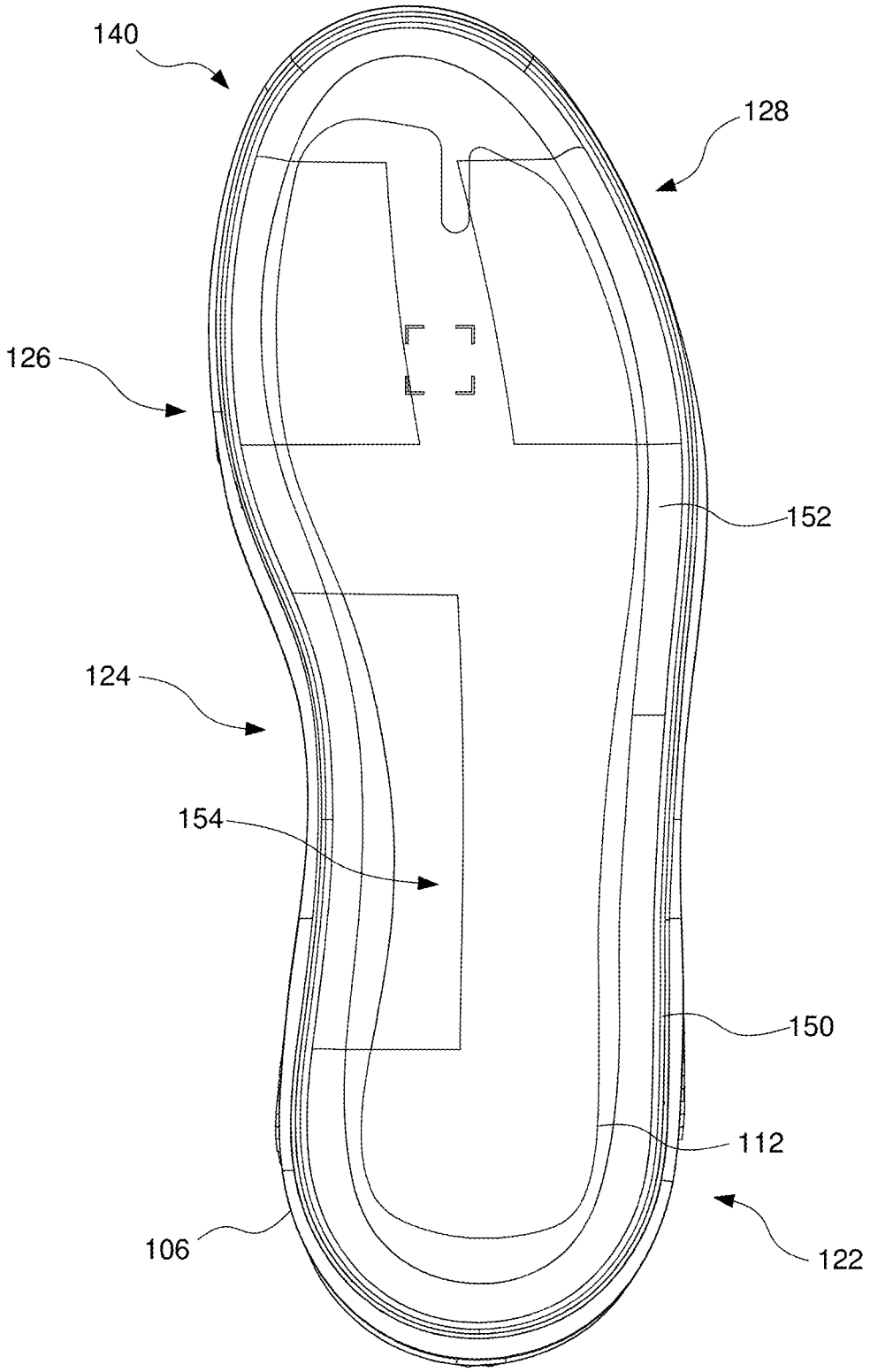
FIG. 14 is a top view of the midsole of the golf shoe of FIG. 1 with the propulsion plate (not shown) and the filler positioned in the cavity of the midsole.

Referring to FIG. 2 and FIGS. 13-14, the filler 112 can be a sheet of foam such as EVA (Ethylene-Vinyl Acetate) foam that has an outline shape matching the outline of the propulsion plate 110. The filler 112 can be seated in the plate cavity 154 of the midsole 106 on top of the propulsion plate 110. The combined thickness of the propulsion plate 110 and the filler 112 can be about the same as the depth of the plate cavity 154, so that the top surface of the filler 112 can be even with the top surface of the midsole 106 surrounding the plate cavity 154.

Figure 15:
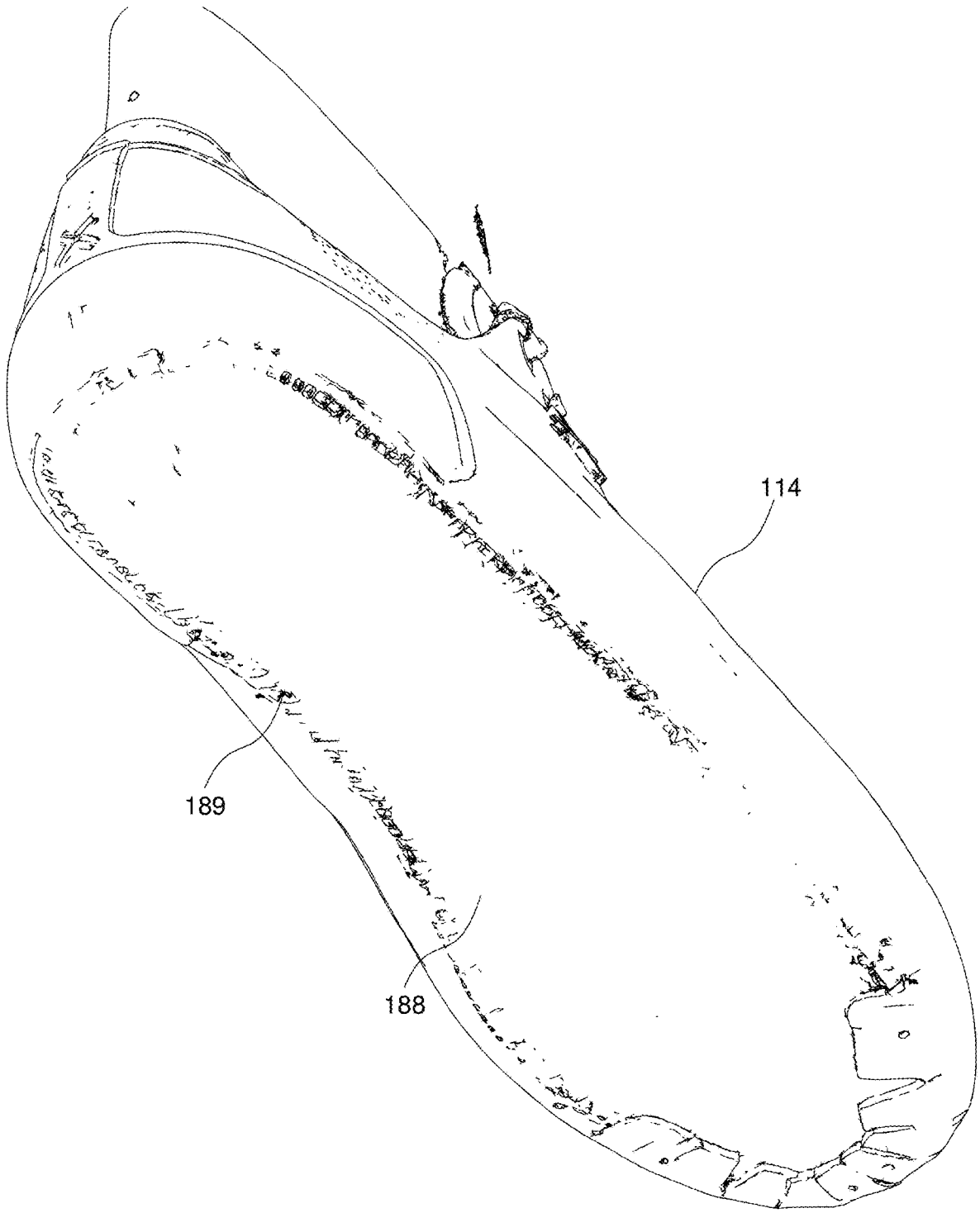
FIG. 15 is a bottom rear lateral perspective view of an upper of the golf shoe of FIG. 1 and a sock prior to a semi-permeable membrane gasket being added to the bottom of the upper.
Figure 16:
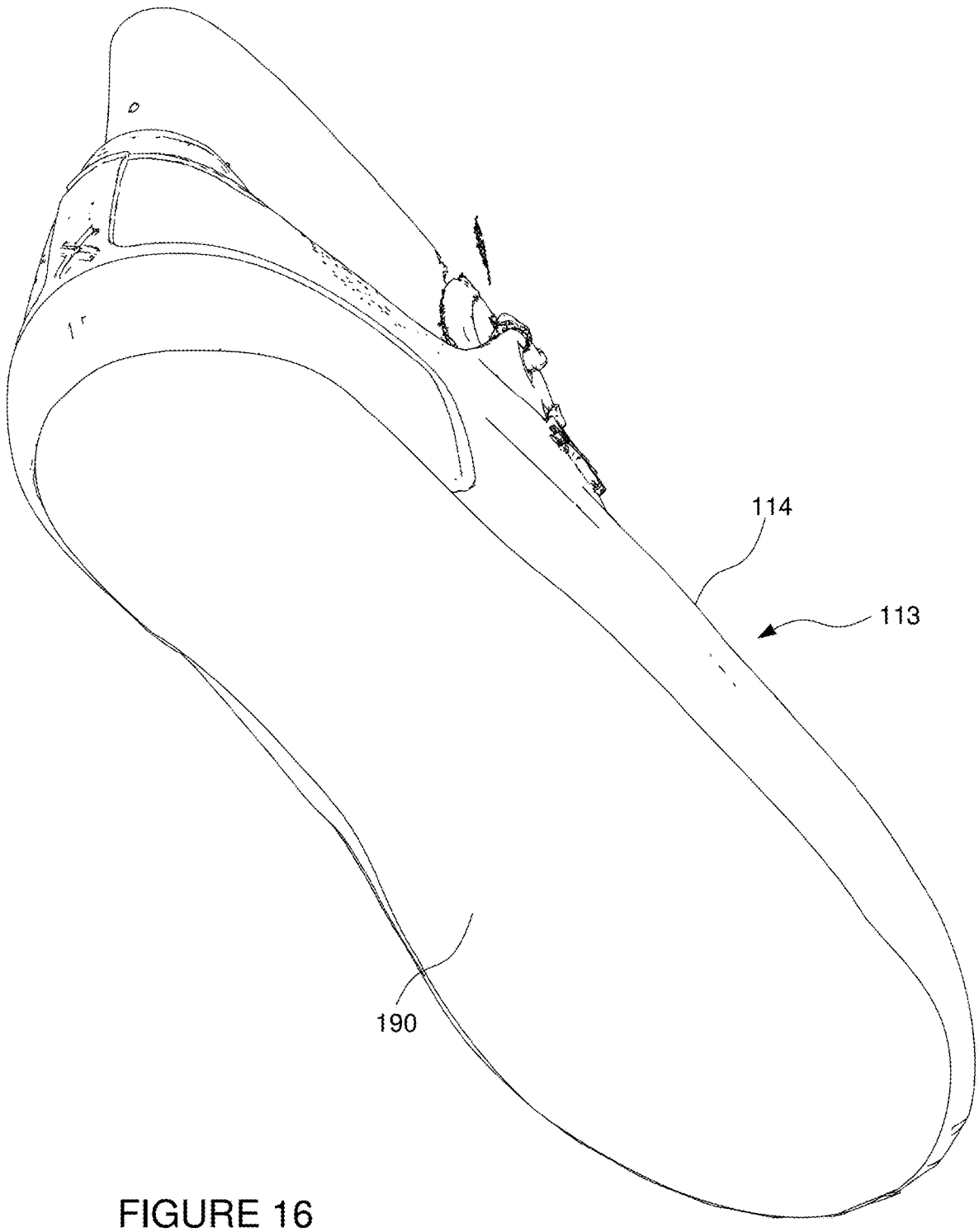
FIG. 16 is a view like FIG. 15, but with the semi-permeable membrane gasket added to the bottom of the upper.

Referring to FIGS. 1-2 and to FIGS. 15-16, the upper assembly 113 including the upper 114 can be positioned on the filler 112 and the midsole 106, with the bottom portion of the upper 114 being seated in the trough 152 of the midsole 106. The upper 114 can define shoelace eyelets for shoelaces and can be secured to other features such as a tongue or tongue booty and shoelaces. An upper liner (not shown) can be secured to the interior of the upper. The upper 114 can be made of a material such as a microfiber material. A lower edge of the upper 114 (and possibly a lower edge of the upper liner) can be stitched to a sock 188 in a Strobel construction at a seam 189, where the sock 188 can be flexible and can include cushioning. However, one or more portions of the lower edge of the upper 114 may extend down around the sock 188 at the front or anterior end of the toe box 128 of the golf shoe 100 as illustrated in FIG. 15 (Strobel construction with a pulled toe tip). In the areas where such portions extend down around the sock 188, the sock 188 can still be secured to the upper 114.

A gasket 190 that can be a waterproof and breathable membrane, and can be secured to an underside of the sock 188. The gasket 190 can extend out and up from the sock 188 to also cover a lower portion of the upper 114 and at least part of the seam 189.

The footbed (not shown) can include a foam layer topped by a fabric layer. The foam layer can be made of a foam material such as a supercritical foam, which may be infused with nitrogen. The footbed can fit inside the lower portion of the upper 114, resting on the flexible sock 188.

The combination of the features discussed above may produce benefits and advantages. For example, some features may combine to produce stiffness and energy return during a golf swing. Such features may include the propulsion plate 110 including its bending stiffness and spring-back action in some bending and/or torsion directions, the foam of the midsole 106 that can compress and spring back (as well as the foam in other components), the air gaps 156 in the midsole 106 that can produce air pockets that can compress and flex out but then spring back to their original positions to produce energy return, and the plate cavity 154 that can flex in and out during a golf swing. Features of the golf shoe 100 can also combine to provide comfort, especially during walking. Such features can include the foam of the midsole 106 and other components of the golf shoe, the extension of the propulsion plate 110 over at least portions of the spike receptacles 136 to inhibit localized pressure on the foot from the spike receptacles, the decreased bending stiffness of the propulsion plate 110 in at least one bending direction (negative bending around medial-lateral axes), the flexible sock 188 that can allow flexibility just below the footbed. Other features can also increase comfort and performance of the golf shoe 100, such as the flexibility features at the flex zone 126 and/or around the first toe area 140 of the toe box 128.

In assembling the golf shoe 100, components discussed above can be secured together. As discussed, the upper 114 can be stitched to the sock 188 and portions of the toe of the upper that are pulled down over the sock 188 may be cemented to the sock 188. Other components may be cemented together. For example, the midsole 106 can be cemented to the outsole 104, the propulsion plate 110 can be cemented to the midsole 106, the filler 112 can be cemented to the propulsion plate 110 and possibly also to the midsole 106 at the edges of the filler 112. The gasket 190 can be cemented to the sock 188, the seam 189, and the upper 114. The gasket 190 and the upper 114 can be cemented to the midsole 106 and the filler 112. An upper liner can be secured to the upper 114 by stitching and/or cementing, and a tongue or tongue booty can be secured to the inside of the upper liner with stitching and/or cementing. The footbed can be placed inside the upper and rest on the sock 188 without being cemented in place. Other components may also be added to or included with the components discussed herein, such as a heel counter at the heel of the upper 114.

II. Spikeless Golf Shoe Example

Figure 17:
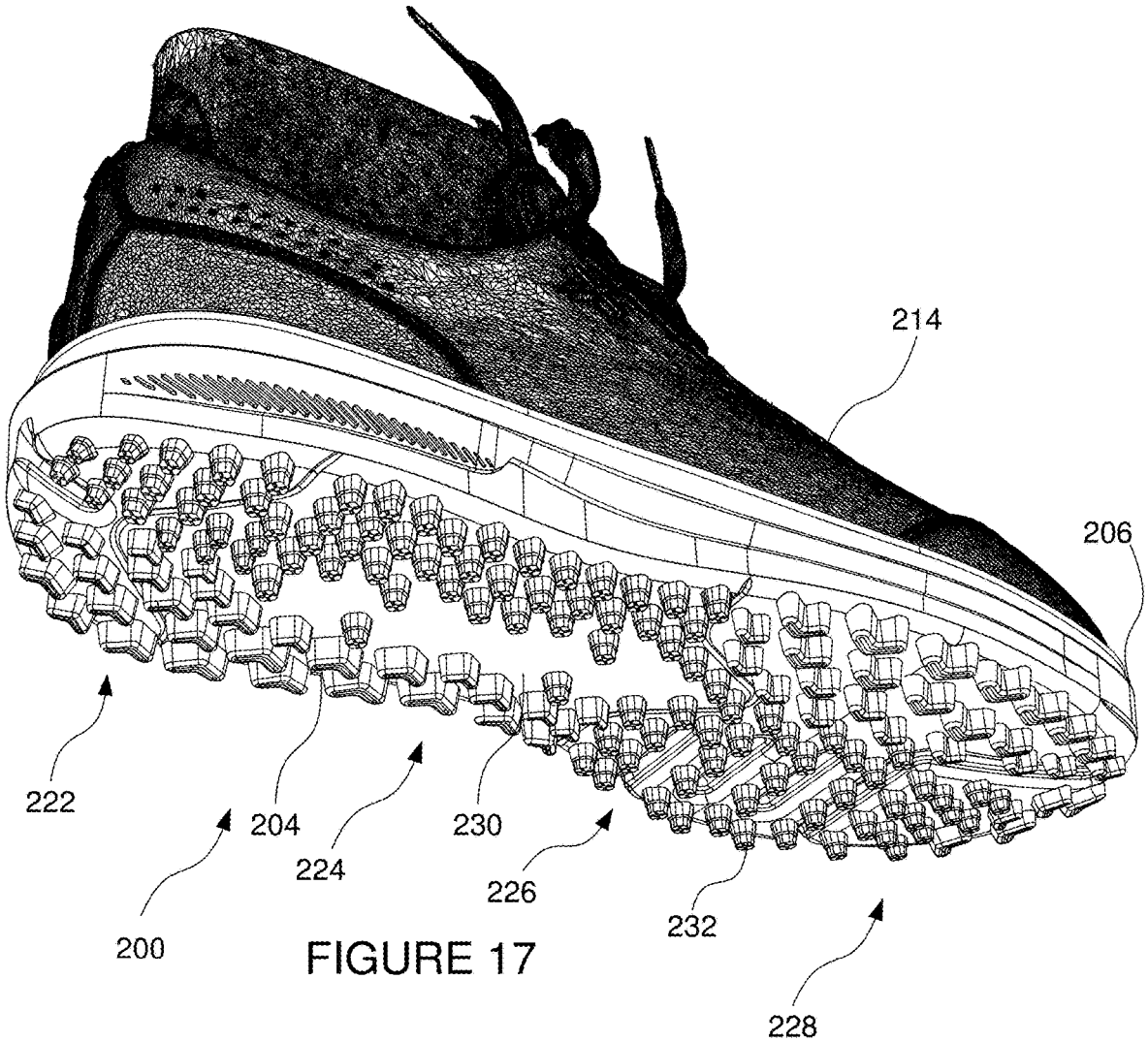
FIG. 17 is a bottom rear lateral perspective view of another golf shoe.

An example of another golf shoe 200 will now be discussed with reference to FIGS. 17-18. The golf shoe 200 is an example of a spikeless golf shoe. The golf shoe 200 can have components like the golf shoe 100 discussed above, including an outsole 204, a midsole 206, a propulsion plate 210, a filler (not shown), an upper 214, and a footbed (not shown). The characteristics and properties of these components may be like the components of the golf shoe 100, and like the golf shoe 100, the golf shoe 200 may include additional components, such as a tong booty, an upper liner, a heel counter, a waterproof breathable gasket, etc. However, the golf shoe 200 may omit the spikes and spike receptacles, and the outsole 204 of the golf shoe 200 may have golf shoe traction features that instead include more cleats 232 extending down from an outsole body 230.

Figure 18:
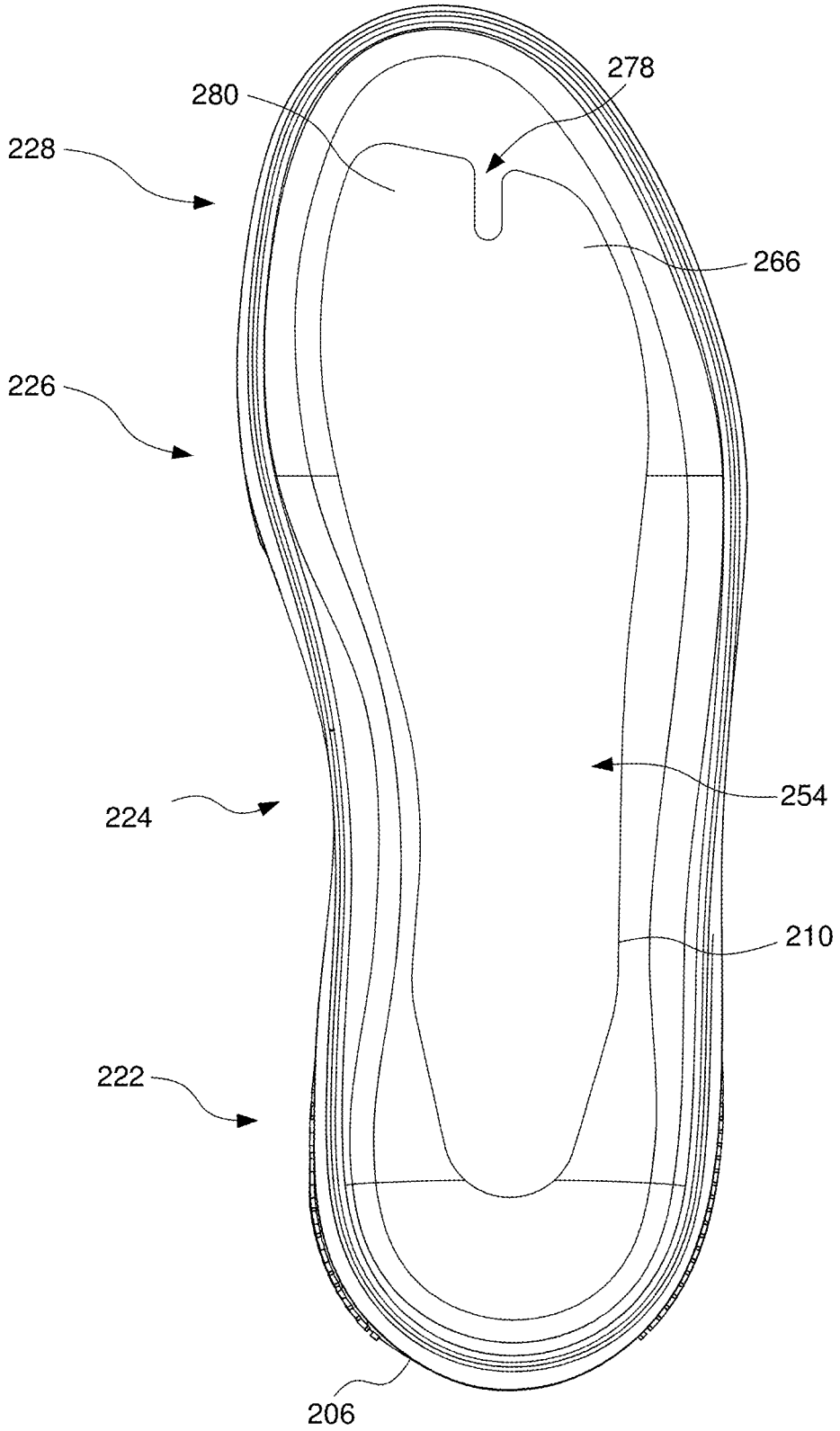
FIG. 18 is a top view of a midsole of the golf shoe of FIG. 17 with a propulsion plate positioned in a cavity of the midsole.

As illustrated in FIG. 18, the outline of the plate cavity 254 of the midsole 206 may be shaped differently than in the golf shoe 100. Likewise, the outline of the propulsion plate 210 and the corresponding filler (not shown) can have outlines that match the plate cavity 254 and are different from the propulsion plate 110 of the golf shoe 100. This difference can be due to the lack of spikes and spike receptacles so that in the golf shoe 200 the propulsion plate 210 may not extend to cover at least parts of such receptacles to inhibit localized spike receptacle pressures from reaching the foot of a wearer. In other words, such localized forces are generally not as much of a problem for spikeless golf shoes such as the golf shoe 200. However, the propulsion plate 210 can still extend from the heel 222 past the midfoot area 224 and flex zone 226, and to the toe box 228 of the golf shoe 200. And the propulsion plate 210 may still include a gap 278 extending rearward (in the posterior direction) from the front or anterior end of the propulsion plate 210, separating a first toe section 280 of the propulsion plate 210 from the remainder of the toe section 266 of the propulsion plate 210. Likewise, the outsole 204 and the midsole 206 can include flexibility features such as grooves, gaps, and/or perforations at the flex zone 226 and the toe box 228 like those in the outsole 104 and the midsole 106 of the golf shoe 100 discussed above. Other features of the golf shoe 200 can also be like the features of the golf shoe 100 discussed above.

The subject matter defined in the appended claims is not necessarily limited to the benefits described herein. A particular implementation of the invention may provide all, some, or none of the benefits described herein. Although operations for the various techniques are described herein in a particular, sequential order for the sake of presentation, it should be understood that this manner of description encompasses rearrangements in the order of operations, unless a particular ordering is required. For example, operations described sequentially may in some cases be rearranged or performed concurrently.

III. Aspects of the Disclosure

Some aspects of the disclosure will now be discussed. In these aspects, features of implementations of these aspects may be combined together with the general aspects and with each other in any combination not precluded by specific language or by the nature of the features and aspects. Some aspects discussed herein and elsewhere in this disclosure can involve techniques. Each of the acts in these techniques can be performed using the golf shoes discussed herein. Indeed, the golf shoes discussed herein can be structured to perform the acts of the techniques, as discussed herein. Also, the golf shoes can include means for performing each of the acts discussed in the context of these techniques (such as via the components of the golf shoes discussed herein), in different combinations.

One or more techniques can include a wearer wearing a golf shoe having one or more features and/or components as discussed herein during a golf swing (i.e., while the wearer is swinging a golf club to hit a golf ball).

According to a first aspect, a golf shoe can include an outsole including golf shoe traction features; a midsole supported by the outsole; and a propulsion plate supported by the midsole. The propulsion plate can be seated in the midsole, and the propulsion plate can be designed to return energy to a user's foot during a golf swing. The propulsion plate can extend from a heel of the golf shoe past a flex zone of the golf shoe. The golf shoe can also include an upper assembly supported by the midsole and the propulsion plate.

The propulsion plate can be sandwiched between foam layers, including between the footbed and the filler above the propulsion plate and the midsole foam layer below the propulsion plate.

The propulsion plate can extend from the heel of the golf shoe to a toe box of the golf shoe, and the propulsion plate can be configured to extend below and support toes of a wearer of the golf shoe.

The propulsion plate can define a groove extending into the propulsion plate in a substantially posterior direction from an anterior end of the propulsion plate. The groove can be positioned on a lateral side of a portion of the propulsion plate that is configured to support a first toe of a wearer of the golf shoe.

The groove can be positioned between a portion of the propulsion plate that is configured to support the first toe of the wearer of the golf shoe and a portion of the propulsion plate that is configured to support a second toe of the wearer of the golf shoe.

A bending stiffness of the propulsion plate for positive bending around a medial-lateral axis can be greater than a bending stiffness of the propulsion plate for negative bending around the medial-lateral axis.

A bending stiffness of the propulsion plate can be less stiff for negative bending around the medial-lateral axis than for positive bending around an anterior-posterior axis or negative bending around the anterior-posterior axis.

The propulsion plate can be seated in a cavity of the midsole.

The propulsion plate can be wider at a toe box of the golf shoe than at the heel of the golf shoe.

The golf shoe can include spike receptacles configured to be removably connected to golf shoe spikes. Also, the propulsion plate can extend over at least a portion of each of the spike receptacles.

A portion of the propulsion plate located on an anterior side of the flex zone can reach a maximum positive angle relative to a midfoot portion of the propulsion plate located between the flex zone and a heel portion of the propulsion plate. For example, the maximum positive angle can be from five degrees to sixteen degrees. As a specific example, the maximum positive angle can be about eleven degrees.

The midsole can include supercritical foam having a hardness that is from forty-seven to fifty-three using an Asker durometer Type C hardness test. For example, the hardness can be about fifty using an Asker durometer Type C hardness test.

In one example, the propulsion plate can extend from the heel of the golf shoe to a toe box of the golf shoe, and the propulsion plate can be configured to support toes of a wearer of the golf shoe; the propulsion plate can define a groove extending into the propulsion plate in a substantially posterior direction from an anterior end of the propulsion plate, the groove being positioned on a lateral side of a portion of the propulsion plate that is configured to support a first toe of a wearer of the golf shoe; a bending stiffness of the propulsion plate for positive bending around a medial-lateral axis can be greater than a bending stiffness of the propulsion plate for negative bending around the medial-lateral axis; a bending stiffness of the propulsion plate can be less stiff for negative bending around the medial-lateral axis than for positive bending around an anterior-posterior axis or negative bending around the anterior-posterior axis; the propulsion plate can be seated in a cavity of the midsole; a portion of the propulsion plate located on an anterior side of the flex zone can reach a maximum positive angle relative to a portion of the propulsion plate located on a posterior side of the flex zone, wherein the maximum positive angle can be from five degrees to sixteen degrees; the upper assembly can include a Strobel construction with a flexible sock; and the midsole can include supercritical foam having a hardness that is from forty-seven to fifty-three using an Asker durometer Type C hardness test. For example, the maximum positive angle may be about eleven degrees.

The midsole can define air gaps that can at least partially define air pockets.

A width of the propulsion plate can be at least sixty percent of a width of the midsole at a line extending laterally across a part of the flex zone.

According to a second aspect, a golf shoe can include an outsole that includes golf shoe traction features, a midsole supported by the outsole, and a propulsion plate supported by the midsole. The propulsion plate can be designed to return energy during a golf swing, and the propulsion plate can be designed to support a heel and toes of a wearer of the golf shoe during a golf swing. The golf shoe can also include an upper assembly supported by the propulsion plate and the midsole.

The propulsion plate can define an aperture extending into the propulsion plate in a substantially posterior direction from an anterior end of the propulsion plate. The aperture can be positioned on a lateral side of a portion of the propulsion plate that is configured to support a first toe of the wearer of the golf shoe.

The propulsion plate can define an aperture extending into the propulsion plate in a substantially posterior direction from an anterior end of the propulsion plate, and the aperture can be positioned on a lateral side of a portion of the propulsion plate that is configured to support a first toe of the wearer of the golf shoe; a bending stiffness of the propulsion plate for positive bending around a medial-lateral axis can be greater than a bending stiffness of the propulsion plate for negative bending around the medial-lateral axis; the propulsion plate can be seated in a cavity of the midsole; a portion of the propulsion plate located on an anterior side of a flex zone of the golf shoe can be at a positive angle relative to a portion of the propulsion plate located on a posterior side of the flex zone; and the midsole can include foam having a hardness that is from forty-seven to fifty-three using an Asker durometer Type C hardness test.

According to a third aspect, a golf shoe can include an outsole including golf shoe traction features, a midsole supported by the outsole, and a propulsion plate supported by the midsole. The propulsion plate can be designed to return energy during a golf swing, and a bending stiffness of the propulsion plate for positive bending around a medial-lateral axis can be greater than a bending stiffness of the propulsion plate for negative bending around the medial-lateral axis. The golf shoe can also include an upper assembly supported by the propulsion plate and the midsole.

A bending stiffness of the propulsion plate can be less stiff for negative bending around the medial-lateral axis than for positive bending around an anterior-posterior axis or negative bending around the anterior-posterior axis.

The upper assembly can include Strobel construction with a flexible sock, and the flexible sock can be supported by the midsole and the propulsion plate.

The upper assembly can include an upper including a microfiber material; the golf shoe can include a breathable waterproof gasket between the upper and the midsole; the propulsion plate can include composite material such as carbon fiber material; the propulsion plate can define a groove extending into the propulsion plate in a substantially posterior direction from an anterior end of the propulsion plate, and the groove can be positioned on a lateral side of a portion of the propulsion plate that is configured to support a first toe of a wearer; the propulsion plate can be seated in a cavity of the midsole; a portion of the propulsion plate located on an anterior side of a flex zone of the golf shoe can be at a positive angle relative to a portion of the propulsion plate located on a posterior side of the flex zone, wherein the positive angle can reach a maximum of from five degrees to sixteen degrees; the golf shoe can include golf shoe spike receptacles and the propulsion plate can extend over at least a portion of each of the golf shoe spike receptacles; and the midsole can include nitrogen infused supercritical foam.

Although subject matter has been described in language specific to features such as compositions of matter, structural features, and/or methodological acts, it is to be understood that the subject matter defined in the appended claims is not necessarily limited to the specific features described above. Rather, the specific features described above are disclosed as example forms of implementing the claims.

We claim:

1. A golf shoe comprising:

an outsole comprising golf shoe traction features;

a midsole supported by the outsole;

a propulsion plate supported by the midsole, the propulsion plate being designed to return energy during a golf swing, and a bending stiffness of the propulsion plate for positive bending around a medial-lateral axis is greater than a bending stiffness of the propulsion plate for negative bending around the medial-lateral axis; and an upper assembly supported by the propulsion plate and the midsole;

wherein:

the upper assembly comprises an upper comprising a microfiber material and a flexible Strobel construction sock;

the propulsion plate comprises carbon fiber composite material;

the propulsion plate defines a groove extending into the propulsion plate in a substantially posterior direction from an anterior end of the propulsion plate, the groove being positioned on a lateral side of a portion of the propulsion plate that is configured to support a first toe of a wearer;

the propulsion plate is seated in a cavity of the midsole;

a portion of the propulsion plate located on an anterior side of a flex zone of the golf shoe reaches a maximum positive angle relative to a portion of the propulsion plate located on a posterior side of the flex zone, wherein the maximum positive angle is from five degrees to sixteen degrees;

the golf shoe comprises golf shoe spike receptacles and the propulsion plate extends over at least a portion of each of the golf shoe spike receptacles;

the golf shoe comprises a breathable waterproof gasket between the upper and the midsole; and the midsole comprises nitrogen infused supercritical foam having a hardness from forty-seven to fifty-three using an Asker durometer Type C hardness test.

2. The golf shoe of claim 1, wherein the propulsion plate extends from a heel of the golf shoe past the flex zone of the golf shoe.

3. The golf shoe of claim 1, wherein the propulsion plate is sandwiched between foam layers.

4. The golf shoe of claim 1, wherein the propulsion plate extends from a heel of the golf shoe to a toe box of the golf shoe, the propulsion plate being configured to support toes of a wearer of the golf shoe.

5. The golf shoe of claim 1, wherein the bending stiffness of the propulsion plate for negative bending around the medial-lateral axis is less than for positive bending around an anterior-posterior axis or negative bending around the anterior-posterior axis.

6. The golf shoe of claim 1, wherein a width of the propulsion plate is at least sixty percent of a width of the midsole at a line extending laterally across a part of the flex zone.

7. A golf shoe comprising:

an outsole comprising golf shoe traction features;

a midsole supported by the outsole;

a propulsion plate supported by the midsole, the propulsion plate being designed to return energy during a golf swing; and an upper assembly supported by the propulsion plate and the midsole;

wherein:

the upper assembly comprises an upper comprising a microfiber material and a flexible Strobel construction sock;

the propulsion plate comprises carbon fiber composite material;

the propulsion plate defines a groove extending into the propulsion plate in a substantially posterior direction from an anterior end of the propulsion plate, the groove being positioned on a lateral side of a portion of the propulsion plate that is configured to support a first toe of a wearer;

the propulsion plate is seated in a cavity of the midsole;

a portion of the propulsion plate located on an anterior side of a flex zone of the golf shoe reaches a maximum positive angle relative to a portion of the propulsion plate located on a posterior side of the flex zone, wherein the maximum positive angle is from five degrees to sixteen degrees;

the golf shoe comprises golf shoe spike receptacles and the propulsion plate extends over at least a portion of each of the golf shoe spike receptacles;

the golf shoe comprises a breathable waterproof gasket between the upper and the midsole; and the midsole comprises nitrogen infused supercritical foam having a hardness from forty-seven to fifty-three using an Asker durometer Type C hardness test.

8. The golf shoe of claim 7, wherein the propulsion plate extends from a heel of the golf shoe past the flex zone of the golf shoe.

9. The golf shoe of claim 7, wherein the propulsion plate is sandwiched between foam layers.

10. The golf shoe of claim 7, wherein the propulsion plate extends from a heel of the golf shoe to a toe box of the golf shoe, the propulsion plate being configured to support toes of a wearer of the golf shoe.

11. The golf shoe of claim 7, wherein a bending stiffness of the propulsion plate for negative bending around a medial-lateral axis is less than for positive bending around an anterior-posterior axis or negative bending around the anterior-posterior axis.

12. The golf shoe of claim 7, wherein a width of the propulsion plate is at least sixty percent of a width of the midsole at a line extending laterally across a part of the flex zone.

13. A golf shoe comprising:

an outsole comprising golf shoe traction features;

a midsole supported by the outsole;

a propulsion plate supported by the midsole, the propulsion plate being designed to return energy during a golf swing, and a bending stiffness of the propulsion plate for positive bending around a medial-lateral axis is greater than a bending stiffness of the propulsion plate for negative bending around the medial-lateral axis; and an upper assembly supported by the propulsion plate and the midsole;

wherein:

the upper assembly comprises an upper comprising a microfiber material and a flexible Strobel construction sock;

the propulsion plate comprises carbon fiber composite material;

the propulsion plate defines a groove extending into the propulsion plate in a substantially posterior direction from an anterior end of the propulsion plate, the groove being positioned on a lateral side of a portion of the propulsion plate that is configured to support a first toe of a wearer;

the propulsion plate is seated in a cavity of the midsole;

a portion of the propulsion plate located on an anterior side of a flex zone of the golf shoe reaches a maximum positive angle relative to a portion of the propulsion plate located on a posterior side of the flex zone, wherein the maximum positive angle is from five degrees to sixteen degrees;

the golf shoe comprises a breathable waterproof gasket between the upper and the midsole; and the midsole comprises nitrogen infused supercritical foam having a hardness from forty-seven to fifty-three using an Asker durometer Type C hardness test.

14. The golf shoe of claim 13, wherein the propulsion plate extends from a heel of the golf shoe past the flex zone of the golf shoe.

15. The golf shoe of claim 13, wherein the propulsion plate is sandwiched between foam layers.

16. The golf shoe of claim 13, wherein the propulsion plate extends from a heel of the golf shoe to a toe box of the golf shoe, the propulsion plate being configured to support toes of a wearer of the golf shoe.

17. The golf shoe of claim 13, wherein the bending stiffness of the propulsion plate for negative bending around the medial-lateral axis is less than for positive bending around an anterior-posterior axis or negative bending around the anterior-posterior axis.

18. The golf shoe of claim 13, wherein a width of the propulsion plate is at least sixty percent of a width of the midsole at a line extending laterally across a part of the flex zone.

* * * * *